US012239177B1

(12) United States Patent
Waldman et al.

(10) Patent No.: US 12,239,177 B1
(45) **Date of Patent: *Mar. 4, 2025**

(54) GARMENT WITH MULTIPLE REGIONS

(71) Applicant: GLOBAL TRADEMARKS, INC., Nazareth, PA (US)

(72) Inventors: Mark Waldman, New Hope, PA (US); Ruth Gordon, Bernardsville, NJ (US); Lisa Mary Butler, Parsippany, NJ (US)

(73) Assignee: Global Trademarks, Inc., Nazareth, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/501,077

(22) Filed: Nov. 3, 2023

Related U.S. Application Data

(62) Division of application No. 16/794,674, filed on Feb. 19, 2020, now Pat. No. 11,857,009.

(60) Provisional application No. 62/807,428, filed on Feb. 19, 2019.

(51) Int. Cl.
*A41D 27/02* (2006.01)
*A41B 9/00* (2006.01)

(52) U.S. Cl.
CPC ..... *A41D 27/02* (2013.01); *A41B 9/00* (2013.01); *A41D 2400/38* (2013.01)

(58) Field of Classification Search
CPC ..... A41D 27/02; A41D 2400/38; A41B 9/00
USPC ..... 2/272, 67
See application file for complete search history.

(56) References Cited

U.S. PATENT DOCUMENTS

| | | | |
|---|---|---|---|
| 1,778,453 | A | 10/1930 | Hargraves |
| 2,102,323 | A | 12/1937 | Kneibler |
| 2,130,906 | A | 9/1938 | Scherfer |
| 2,225,721 | A | 12/1940 | Solomon |
| 2,344,375 | A | 3/1944 | Stephens |
| 2,506,826 | A | 5/1950 | Ford |
| 2,519,602 | A | 8/1950 | Rago |
| 2,561,312 | A | 7/1951 | Laszlo |
| 2,563,308 | A | 8/1951 | Chase et al. |
| D166,167 | S | 3/1952 | Annis |
| 2,628,354 | A | 2/1953 | Laguzzi |
| 2,739,312 | A | 3/1956 | Morano |
| 2,752,599 | A | 7/1956 | Laguzzi |

(Continued)

OTHER PUBLICATIONS

Swimsuit Brochure, 2013, 9 pages.
Swimsuit Brochure, 2014, 2 pages.

*Primary Examiner* — Gloria M Hale
(74) *Attorney, Agent, or Firm* — Ruggiero McAllister & McMahon LLC

(57) ABSTRACT

A liner includes a fabric body that covers at least a hip area and an abdomen area of a wearer or the hip area and buttocks area of a wearer. The fabric body having at least a first region and a second region each having a different modulus than another of the several regions. The first region is an abdominal region or a buttocks region. The second region is selected from the following group of regions, namely a first abdominal border region, a second abdominal border region, a buttocks region if the buttocks region is not the first region, a bottom buttocks surrounding region, a top buttocks surrounding region, a side buttocks surrounding region, a side hip region, a waist whittler region, a waist transition region, a super waist whittler region, an abdominal region if the abdominal region is not the first region and any combination thereof.

24 Claims, 32 Drawing Sheets

(56) References Cited

U.S. PATENT DOCUMENTS

| | | | |
|---|---|---|---|
| 2,910,984 | A | 11/1959 | Yeakey et al. |
| 2,942,605 | A | 6/1960 | Erteszek |
| 2,950,718 | A | 8/1960 | Erteszek |
| 2,969,068 | A | 1/1961 | Murdock |
| 2,973,765 | A | 3/1961 | Diebold |
| 3,137,300 | A | 6/1964 | Gingras |
| 3,185,160 | A | 5/1965 | Gingras |
| 3,339,554 | A | 9/1967 | Nobbs |
| 3,395,712 | A | 8/1968 | Laguzzi |
| 3,406,692 | A | 10/1968 | Pernas |
| 3,468,313 | A | 9/1969 | Blair et al. |
| 3,756,247 | A | 9/1973 | Hand |
| 3,894,542 | A | 7/1975 | Sacristan |
| 4,179,754 | A | 12/1979 | Denu |
| 4,654,894 | A | 4/1987 | Kudo |
| 4,916,755 | A | 4/1990 | Feigenbaum et al. |
| 5,452,477 | A | 9/1995 | Mann |
| 5,533,961 | A | 7/1996 | Iwata |
| 5,787,732 | A | 8/1998 | Perron et al. |
| 5,888,118 | A | 3/1999 | Kishi |
| 5,954,564 | A | 9/1999 | Ganz |
| 6,298,486 | B1 | 10/2001 | Huang |
| D453,059 | S | 1/2002 | Kim |
| D453,258 | S | 2/2002 | Kim |
| D453,408 | S | 2/2002 | Kim |
| D454,423 | S | 3/2002 | Kim |
| D485,047 | S | 1/2004 | Oya et al. |
| 6,728,973 | B1 | 5/2004 | Webley et al. |
| 6,874,337 | B2 | 4/2005 | Uno et al. |
| 7,087,032 | B1 | 8/2006 | Ikeda |
| 7,260,961 | B1 | 8/2007 | Kennedy |
| 7,341,500 | B2 | 3/2008 | Horn et al. |
| 7,377,834 | B2 | 5/2008 | Fu |
| 7,509,822 | B2 | 3/2009 | Ishida et al. |
| 7,526,929 | B2 | 5/2009 | Yakamoto et al. |
| 7,546,751 | B2 | 6/2009 | Lutz |
| 7,559,093 | B2 | 7/2009 | Sudo et al. |
| 7,631,367 | B2 | 12/2009 | Caillibotte et al. |
| 7,814,569 | B2 | 10/2010 | Di Lorenzo |
| 8,356,363 | B2 | 1/2013 | Caillobotte et al. |
| 8,407,814 | B2 | 4/2013 | Caillobotte et al. |
| 8,578,514 | B2 | 11/2013 | Caillibotte et al. |
| 9,119,424 | B2 | 9/2015 | Kakuno et al. |
| 9,456,640 | B2 | 10/2016 | Kemma et al. |
| 9,468,235 | B2 | 10/2016 | Turlan-Van Der Hoeven et al. |
| 11,857,009 | B2 * | 1/2024 | Waldman ..... A41D 1/00 |
| 2008/0256675 | A1 | 10/2008 | Di Lorenzo |
| 2009/0038047 | A1 | 2/2009 | Di Lorenzo |
| 2011/0225696 | A1 | 9/2011 | Di Lorenzo |
| 2013/0186150 | A1 | 7/2013 | Pilawa et al. |
| 2014/0250561 | A1 | 9/2014 | Di Lorenzo |
| 2015/0121602 | A1 | 5/2015 | Decker |

* cited by examiner

Table 1

| | A | B | C | E | F | H | I | K | L | N | O | Q | R | S | U | V | X | Y | AA | AB | AD | AE | AG |
|---|---|---|---|---|---|---|---|---|---|---|---|---|---|---|---|---|---|---|---|---|---|---|---|
| 1 | | | | | | | | | | | | | | | | | | | | | | | |
| 2 | Region | Location | " W on the body" | "W on the body" - 20% value | "W on the body" + 20% value | "W on the body" - 30% value | "W on the body" + 30% value | "W on the body" - 40% value | "W on the body" + 40% value | "W on the body" - 40% value | "W on the body" - 40% value | "W on the body" - 50% value | "W on the body" + 50% value | " L on the body" | "L on the body" - 20% value | "L on the body" + 20% value | "L on the body" - 30% value | "L on the body" + 30% value | "L on the body" - 40% value | "L on the body" + 40% value | "L on the body" - 40% value | "L on the body" + 40% value | "L on the body" - 50% value |
| 3 | 22 Waist Transition | Waist Transition | 133% | 106.4 | 159.6 | 93.1 | 172.9 | 79.8 | 186.2 | 73.15 | 192.85 | 66.5 | 199.5 | X | | | | | | | | | |
| 4 | 18 Waist Whittler | Waist Whittler | 160% | 128 | 192 | 112 | 208 | 96 | 224 | 88 | 232 | 80 | 240 | X | | | | | | | | | |
| 5 | 24/26 Abdominal Borders | Abdominal Borders | X | | | | | | | | | | | 149% | 119.2 | 178.8 | 104.3 | 193.7 | 89.4 | 208.6 | 81.95 | 216.05 | 74.5 |
| 6 | 27/29 1st & 2nd Side | 1st & 2nd Side | 139% | 111.2 | 166.8 | 97.3 | 180.7 | 83.4 | 194.6 | 76.45 | 201.55 | 69.5 | 208.5 | 116% | 92.8 | 139.2 | 81.2 | 150.8 | 69.6 | 162.4 | 63.8 | 168.2 | 58 |
| 7 | 8 Super Waist Whittler | Super Waist Whittler | 128% | 102.4 | 153.6 | 89.6 | 166.4 | 76.8 | 179.2 | 70.4 | 185.6 | 64 | 192 | 150% | 120 | 180 | 105 | 195 | 90 | 210 | 82.5 | 217.5 | 75 |
| 8 | 17 Buttocks Surrounding | Buttocks Surrounding | X | | | | | | | | | | | 119% | 95.2 | 142.8 | 83.3 | 154.7 | 71.4 | 166.6 | 65.45 | 172.55 | 59.5 |
| 9 | 15 Top Buttocks Surrounding | Top Buttocks Surrounding 15° | X | | | | | | | | | | | X | | | | | | | | | |
| 10 | 15 Top Buttocks Surrounding | Top Buttocks Surrounding 45° | X | | | | | | | | | | | X | | | | | | | | | |
| 11 | 12 Bottom Buttocks Surrounding | Bottom Buttocks Surrounding | X | | | | | | | | | | | X | | | | | | | | | |
| 12 | 13 Buttocks | Buttocks | 177% | 141.6 | 212.4 | 123.9 | 230.1 | 106.2 | 247.8 | 97.35 | 256.65 | 88.5 | 265.5 | 175% | 140 | 210 | 122.5 | 227.5 | 105 | 245 | 96.25 | 253.75 | 87.5 |
| 13 | 10 Abdominal | Abdominal 13093 (Sizes 8-10-12) | 115% | 92 | 138 | 80.5 | 149.5 | 69 | 161 | 63.25 | 166.75 | 57.5 | 172.5 | 136% | 108.8 | 163.2 | 95.2 | 176.8 | 81.6 | 190.4 | 74.8 | 197.2 | 68 |
| 14 | 10 Abdominal | Abdominal 13094 (Sizes 14-16-18) | 117% | 93.6 | 140.4 | 81.9 | 152.1 | 70.2 | 163.8 | 64.35 | 169.65 | 58.5 | 175.5 | 130% | 104 | 156 | 91 | 169 | 78 | 182 | 71.5 | 188.5 | 65 |
| 15 | 10 Abdominal | Average done on Mannequin ONLY | | | | | | | | | | | | | | | | | | | | | |
| 16 | | | | | | | | | | | | | | | | | | | | | | | |
| 17 | | | | | | | | | | | | | | | | | | | | | | | |

FIG. 17

Table 1 (Continued)

| | AH | AL | AK | AL | AN | AO | AQ | AR | AT | AU | AW | AX | AY | BA | BB | BD | BE | BG | BH | BJ | BK | BM | BN |
|---|---|---|---|---|---|---|---|---|---|---|---|---|---|---|---|---|---|---|---|---|---|---|---|
| 1 | | | | | | | | | | | | | | | | | | | | | | | |
| 2 | "W on the body" + 50% value | "W on the body" Modulus at 30% | "W on the body" Modulus - 20% value | "W on the body" Modulus + 20% value | "W on the body" Modulus - 30% value | "W on the body" Modulus + 30% value | "W on the body" Modulus - 40% value | "W on the body" Modulus + 40% value | "W on the body" Modulus - 45% value | "W on the body" Modulus + 45% value | "W on the body" Modulus - 50% value | "W on the body" Modulus + 50% value | "L on the body" Modulus at 30% | "L on the body" Modulus - 20% value | "L on the body" Modulus + 20% value | "L on the body" Modulus - 30% value | "L on the body" Modulus + 30% value | "L on the body" Modulus - 40% value | "L on the body" Modulus + 40% value | "L on the body" Modulus - 45% value | "L on the body" Modulus + 45% value | "L on the body" Modulus - 50% value | "L on the body" Modulus + 50% value |
| 3 | | **0.72** | 0.576 | 0.864 | 0.504 | 0.936 | **0.432** | **1.008** | 0.396 | 1.044 | 0.36 | 1.08 | X | | | | | | | | | | |
| 4 | | **0.57** | 0.456 | 0.684 | 0.399 | 0.741 | **0.342** | **0.798** | 0.3135 | 0.8265 | 0.285 | 0.855 | X | | | | | | | | | | |
| 5 | 223.5 | X | | | | | | | | | | | **0.57** | 0.456 | 0.684 | 0.399 | 0.741 | **0.342** | **0.798** | 0.3135 | 0.8265 | 0.285 | 0.855 |
| 6 | 174 | **0.86** | 0.688 | 1.032 | 0.602 | 1.118 | **0.516** | **1.204** | 0.473 | 1.247 | 0.43 | 1.29 | **1.6** | 1.28 | 1.92 | 1.12 | 2.08 | **0.96** | **2.24** | 0.88 | 2.32 | 0.8 | 2.4 |
| 7 | 225 | **1.11** | 0.888 | 1.332 | 0.777 | 1.443 | **0.666** | **1.554** | 0.6105 | 1.6095 | 0.555 | 1.665 | **0.67** | 0.536 | 0.804 | 0.469 | 0.871 | **0.402** | **0.938** | 0.3685 | 0.9715 | 0.335 | 1.005 |
| 8 | 178.5 | X | | | | | | | | | | | **1.41** | 1.128 | 1.692 | 0.987 | 1.833 | **0.846** | **1.974** | 0.7755 | 2.0445 | 0.705 | 2.115 |
| 9 | | X | | | | | | | | | | | X | | | | | | | | | | |
| 10 | | X | | | | | | | | | | | X | | | | | | | | | | |
| 11 | | X | | | | | | | | | | | X | | | | | | | | | | |
| 12 | 262.5 | **0.53** | 0.424 | 0.636 | 0.371 | 0.689 | **0.318** | **0.742** | 0.2915 | 0.7685 | 0.265 | 0.795 | **0.41** | 0.328 | 0.492 | 0.287 | 0.533 | **0.246** | **0.574** | 0.2255 | 0.5945 | 0.205 | 0.615 |
| 13 | 204 | **1.14** | 0.912 | 1.368 | 0.798 | 1.482 | **0.684** | **1.596** | 0.627 | 1.653 | 0.57 | 1.71 | **0.81** | 0.648 | 0.972 | 0.567 | 1.053 | **0.486** | **1.134** | 0.4455 | 1.1745 | 0.405 | 1.215 |
| 14 | 195 | **0.98** | 0.784 | 1.176 | 0.686 | 1.274 | **0.588** | **1.372** | 0.539 | 1.421 | 0.49 | 1.47 | **0.9** | 0.72 | 1.08 | 0.63 | 1.17 | **0.54** | **1.26** | 0.495 | 1.305 | 0.45 | 1.35 |
| 15 | | **1.06** | 0.848 | 1.272 | 0.742 | 1.378 | **0.636** | **1.484** | 0.583 | 1.537 | 0.53 | 1.59 | **0.855** | 0.684 | 1.026 | 0.598 | 1.11 | **0.513** | **1.197** | 0.4703 | 1.2398 | 0.4275 | 1.2825 |
| 16 | | | | | | | | | | | | | | | | | | | | | | | |
| 17 | | | | | | | | | | | | | | | | | | | | | | | |

FIG. 18A

Table 1 (continued)

TO FIG. 18B-2

| | BO | BQ | BR | BT | BU | BW | BX | BZ | CA |
|---|---|---|---|---|---|---|---|---|---|
| 1 | | | | | | | | | |
| 2 | 45 Degrees | 45 DEGREES - 20% value | 45 DEGREES + 20% value | 45 DEGREES - 30% value | 45 DEGREES + 30% value | 45 DEGREES - 40% value | 45 DEGREES + 40% value | 45 Degrees - 45% value | 45 Degrees + 45% value |
| 3 | x | | | | | | | | |
| 4 | x | | | | | | | | |
| 5 | x | | | | | | | | |
| 6 | x | | | | | | | | |
| 7 | x | | | | | | | | |
| 8 | x | | | | | | | | |
| 9 | x | | | | | | | | |
| 10 | **167%** | 133.6 | 200.4 | 116.9 | 217.1 | **100.2** | **233.8** | 91.85 | 242.15 |
| 11 | **105.50%** | 84.4 | 126.6 | 73.85 | 137.15 | **63.3** | **147.7** | 58.025 | 152.98 |
| 12 | | | | | | | | | |
| 13 | | | | | | | | | |
| 14 | | | | | | | | | |
| 15 | | | | | | | | | |
| 16 | | | | | | | | | |
| 17 | | | | | | | | | |

FIG. 18B-1

FROM FIG. 18B-1

Table 1 (continued)

TO FIG. 18B-3

| CC | CD | CE | CG | CH | CJ | CK | CM | CN |
|---|---|---|---|---|---|---|---|---|
| 45 Degrees - 50% value | 45 Degrees + 50% value | 45 Degree Modulus at 30% | 45 DEGREES MOD @ 30% - 20% value | 45 DEGREES MOD @ 30% + 20% value | 45 DEGREES MOD @ 30% - 30% value | 45 DEGREES MOD @ 30% + 30% value | 45 DEGREES MOD @ 30% - 40% value | 45 DEGREES MOD @ 30% + 40% value |
| | | x | | | | | | |
| | | x | | | | | | |
| | | x | | | | | | |
| | | x | | | | | | |
| | | x | | | | | | |
| | | x | | | | | | |
| | | x | | | | | | |
| 83.5 | 250.5 | **0.38** | 0.304 | 0.456 | 0.266 | 0.494 | **0.228** | **0.532** |
| 52.75 | 158.25 | **1.69** | 1.352 | 2.028 | 1.183 | 2.197 | **1.014** | **2.366** |

FIG. 18B-2

FROM FIG. 18B-1

Table 1 (continued)

| CP | CQ | CS | CT | CU | CW |
|---|---|---|---|---|---|
| 45 DEGREES MOD @ 30% - 45% value | 45 DEGREES MOD @ 30% + 45% value | 45 DEGREES MOD @ 30% - 50% value | 45 DEGREES MOD @ 30% + 50% value | 15 Degrees | 45 DEGREES - 20% value |
| | | | | 150% | 120 |
| 0.209 | 0.551 | 0.19 | 0.57 | | |
| 0.9295 | 2.4505 | 0.845 | 2.535 | | |

FIG. 18B-3

Table 1 (continued)

| | CX | CZ | DA | DC | DD | DF | DG | DI |
|---|---|---|---|---|---|---|---|---|
| 1 | | | | | | | | |
| 2 | 15 DEGREES + 20% value | 15 DEGREES - 30% value | 15 DEGREES + 30% value | 15 DEGREES - 40% value | 15 DEGREES + 40% value | 15 DEGREES - 45% value | 15 DEGREES + 45% value | 15 DEGREES - 50% value |
| 3 | | | | | | | | |
| 4 | | | | | | | | |
| 5 | | | | | | | | |
| 6 | | | | | | | | |
| 7 | | | | | | | | |
| 8 | | | | | | | | |
| 9 | **180** | 105 | 195 | **90** | **210** | 82.5 | 217.5 | 75 |
| 10 | | | | | | | | |
| 11 | | | | | | | | |
| 12 | | | | | | | | |
| 13 | | | | | | | | |
| 14 | | | | | | | | |
| 15 | | | | | | | | |
| 16 | | | | | | | | |
| 17 | | | | | | | | |

TO FIG. 18C-2

FIG. 18C-1

Table 1 (continued)

FROM FIG. 18C-1 TO FIG. 18C-3

| DJ | DK | DM | DN | DP | DQ |
|---|---|---|---|---|---|
| 15 DEGREES + 50% value | 15 Degree Modulus at 30% | 15 DEGREES MOD @ 30% - 20% value | 15 DEGREES MOD @ 30% + 20% value | 15 DEGREES MOD @ 30% - 30% value | 15 DEGREES MOD @ 30% + 30% value |
| 225 | **0.72** | 0.576 | 0.864 | 0.504 | 0.936 |

FIG. 18C-2

Table 1 (continued)

FROM FIG. 18C-1

| DS | DT | DV | DW | DY | DZ |
|---|---|---|---|---|---|
| *15 DEGREES MOD @ 30% - 40% value* | *15 DEGREES MOD @ 30% + 40% value* | *15 DEGREES MOD @ 30% - 45% value* | *15 DEGREES MOD @ 30% + 45% value* | *15 DEGREES MOD @ 30% - 50% value* | *15 DEGREES MOD @ 30% + 50% value* |
| **0.432** | **1.008** | 0.396 | 1.044 | 0.36 | 1.08 |

FIG. 18C-3

(0027 & 0028) FIGURE FOR CLEAN FINISH SEWING
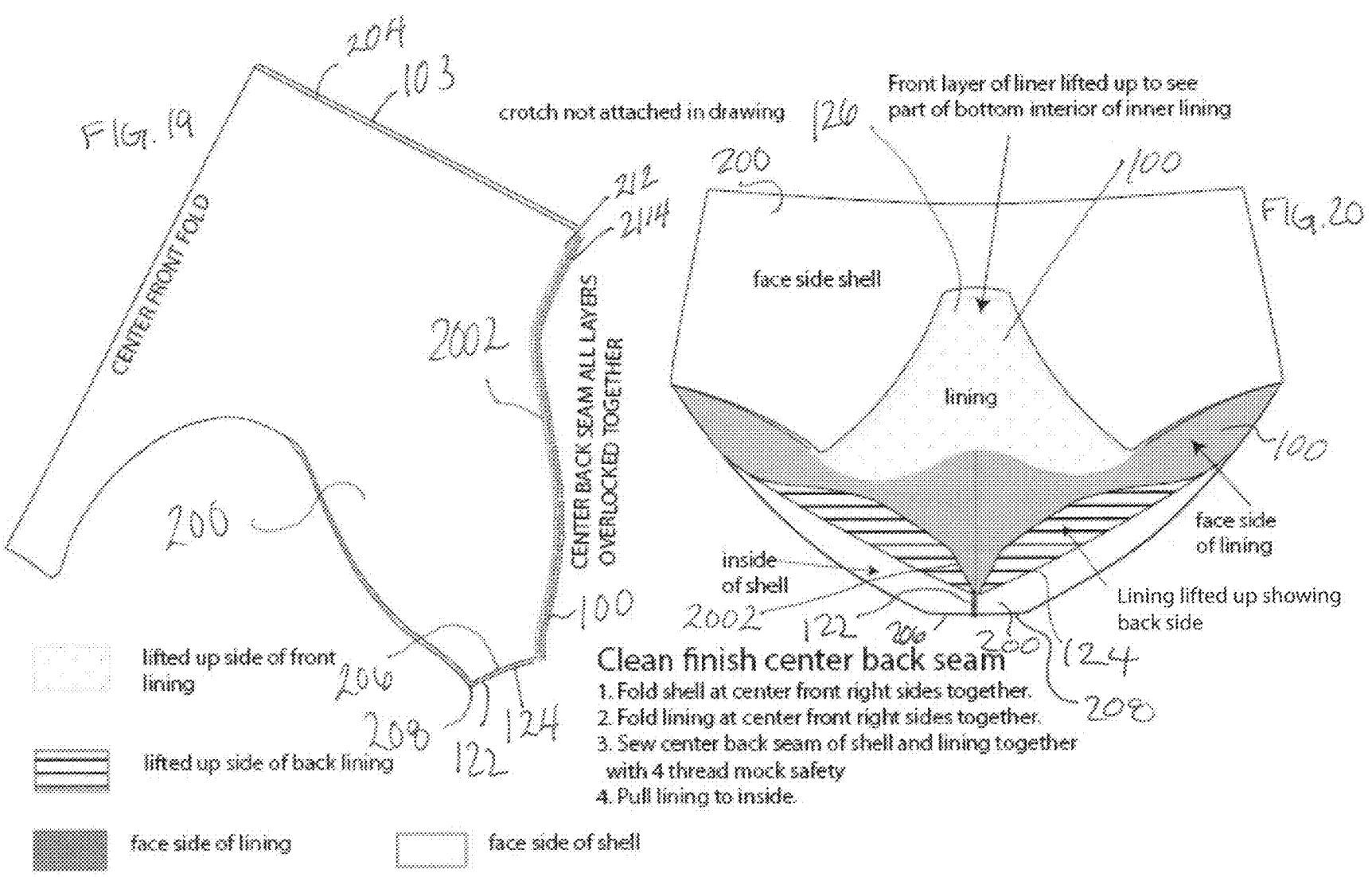

GARMENT WITH MULTIPLE REGIONS

This application is a divisional of prior application Ser. No. 16/794,674, filed Feb. 19, 2020 that issued as U.S. Pat. No. 11,857,007 on January 2024 that claims the benefit of U.S. Provisional Application No. 62/807,428, filed Feb. 19, 2019. The contents of U.S. application Ser. No. 16/794,674, filed Feb. 19, 2020 that issued as U.S. Pat. No. 11,857,009 on January 2024 and U.S. Provisional Application No. 62/807,428, filed Feb. 19, 2019, are hereby incorporated by reference herein in their entirety.

BACKGROUND OF THE DISCLOSURE

1. Field of the Disclosure

The present disclosure relates generally to a garment that is a liner or a liner connected to a shell that reshapes and supports a body of a wearer. More particularly, the present disclosure relates to a liner that has regions for reshaping different areas of a body of a wearer.

2. Description of Related Art

There currently exist numerous garments that can be on the inside or the outside of a garment that offer various degrees of shaping and support to flatter a figure of a wearer. Often such garments have support panels that feature an elastic component that stretches over a desired body part to offer a redistribution and/or reshaping of the shape of the wearer or support. Typically, these garments fail to support a sufficient number of areas to result in body shaping to redistribute the wearer's body shape in a manner that is desirable to the wearer. Moreover, typically these garments merely provide a material having one or two variations of elasticity that fail to account for different areas of the body requiring different levels of support, comfort and control.

Accordingly, it has been determined by the present disclosure, there is a need for a liner having regions each having different attributes for different areas of the body, such as a different elasticity or placement of elasticity, than another of the regions of the liner.

SUMMARY OF THE DISCLOSURE

The present disclosure provides a fabric body having a plurality of regions, preferably three or more, in which each region has a different modulus than any other region so that the combination of regions and different modulus result in multiple benefits including re-sculpting, streamlining, reshaping and smoothing a wearer's body. As defined herein, re-sculpt means more desirable torso curves.

The present disclosure also provides a liner that includes a fabric body having a plurality of regions with at least separate regions that cover at least a hip area and an abdomen area of a wearer or at least the hip area and a buttocks area of a wearer.

The present disclosure further provides, in one embodiment, a fabric body having a plurality of regions including at least a first region and a second region. The first region and the second region each have a different modulus than another of the plurality of regions. The first region is an abdominal region or a buttocks region. The second region is one of: the abdominal region if the abdominal region is not the first region, a first abdominal border region, a second abdominal border region, a buttocks region if the buttocks region is not the first region, a bottom buttocks surrounding region, a top buttocks surrounding region, a side buttocks surrounding region, a side hip region, a waist whittler region, a waist transition region, or a super waist whittler region.

The above-described and other advantages and features of the present disclosure will be appreciated and understood by those skilled in the art from the following detailed description, drawings, and appended claims.

BRIEF DESCRIPTION OF THE DRAWINGS

FIG. 17 is Table 1 that shows elongation in the length direction, width direction, 45 degree direction and/or 15 degree direction, as on the body and modulus at 30 percent elongation with a load of 15 pounds in the length direction, the width direction, 45 degree direction and/or 15 degree direction, as if on the body, of the regions of the liner of the present disclosure noting that the testing was done on flat fabric.

FIG. 18A is a continuation of Table 1.

FIGS. 18B-1, 18B-2 and 18B-3 are a continuation of Table 1.

FIGS. 18C-1, 18C-2 and 18C-3 are continuation of Table 1.

FIG. 19 is a schematic drawing of an outer shell that has been folded and placed down on the first embodiment of the liner that has been folded so that four ply of fabric are on top of one another.

FIG. 20 is a schematic drawing of the outer shell that has been turned inside out placing the first embodiment of the liner inside of the outer shell after the four ply of fabric of FIG. 19 are sewn together.

DETAILED DESCRIPTION OF THE DISCLOSURE

Figure 1:
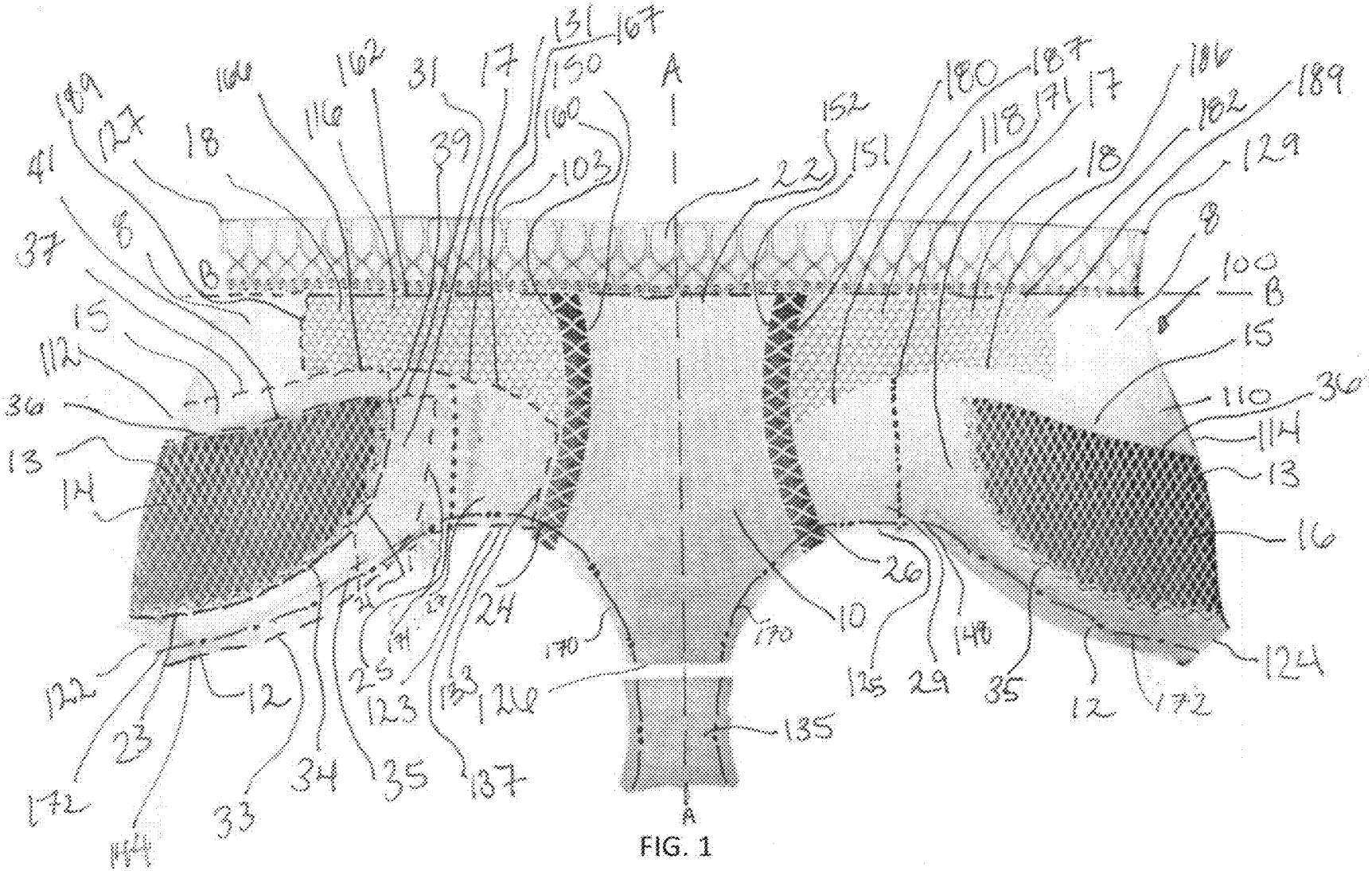
FIG. 1 is a front view of a lining flat pattern for which encompasses both a back and front of a liner and a crotch piece according to a first embodiment of the present disclosure.

Referring to the drawings and, in particular to FIG. 1, an exemplary embodiment of a liner of the present disclosure is generally referred to by reference numeral 100. Liner 100 can be incorporated into a garment, for example, panty, jeans, pants, a skirt, a top, a one piece swimsuit, a tankini, a swimsuit bottom, a lingerie body suit, and/or all body suits, a shapewear bottom, leggings, jeggings, legwear, hosiery, dress, and any combination thereof. Alternatively, liner 100 alone can form a garment, for example, an underwear brief or other lingerie. Liner 100 has a body of fabric or fabric body 110 that reshapes and supports a body of a wearer and a crotch piece 135.

Fabric body 110 has regions with an elastic component that stretches over a desired body part to offer multiple slimming, reshaping or support areas. The regions of liner 100 include one or more of: a super waist whittler region 8, an abdominal region 10, a first abdominal border region 24, a second abdominal border region 26, a buttocks region 13, a bottom buttock surrounding region 12, a top buttock surrounding region 15, a side buttock surrounding region 17, a first side hip region 27, a second side hip region 29, a waist whittler region 18, and a waist transition region 22. Significantly, each region has a different elasticity or modulus of elasticity than one or more of the other regions.

Liner 100 of FIG. 1 is shown having eleven regions. However, more or less than eleven regions can be incorporated into liner 100. A region is defined as an area set off as having a distinct modulus and/or elongation as compared to one or more surrounding or adjoining regions, areas or parts. A region is separated from one or more contiguous regions by means that separate the modulus of that region from the contiguous regions. In some examples discussed below, a seam is used to do so. In some other examples, a border is used to dos so. In some other examples, the attachment or fabric connection of the two regions is the line of separation and that line of separation may not be discernible visually.

As shown in FIG. 1, the eleven regions are: (1) abdominal region 10, (2) first abdominal border region 24 and second abdominal border region 26, (3) buttocks region 13, (4) bottom buttocks surrounding region 12, (5) side buttocks surrounding region 17, (6) top buttocks surrounding region 15, (7) first side hip region 27 and second side hip region 29, (8) waist whittler region 18, (9) waist transition region 22, (10) super waist whittler region 8, and (11) crotch piece 135. Fabric body 110 is free of seams between seven of the regions due to a center back seam 132 going through four regions when liner 100 is assembled, namely: buttocks region 13, top buttocks surrounding region 15, waist transition region 22, and super waist whittler region 8. There are two crotch seams and center back seam 132 when liner 100 is assembled.

The shape of (1) abdominal region 10, (2) first abdominal border region 24 and second abdominal border region 26, (3)

buttocks region 13, (4) bottom buttocks surrounding region 12, (5) side buttocks surrounding region 17, (6) top buttocks surrounding region 15, (7) first side hip region 27 and second side hip region 29, (8) waist whittler region 18, (9) waist transition region 22, (10) super waist whittler region 8, and (11) crotch piece 135 adjusts to different wearers' shapes and/or sizes and reshapes the wearer's body.

Fabric body 110 has a top edge 103, a first side edge portion 112, a second side edge portion 114, a first bottom side edge portion 122, a second bottom side edge portion 124, a middle edge portion 126, a first leg hole portion 123 between first bottom side edge portion 122 and middle edge portion 126, and a second leg hole portion 125 between second bottom side edge portion 124 and middle edge portion 126.

Figure 3:
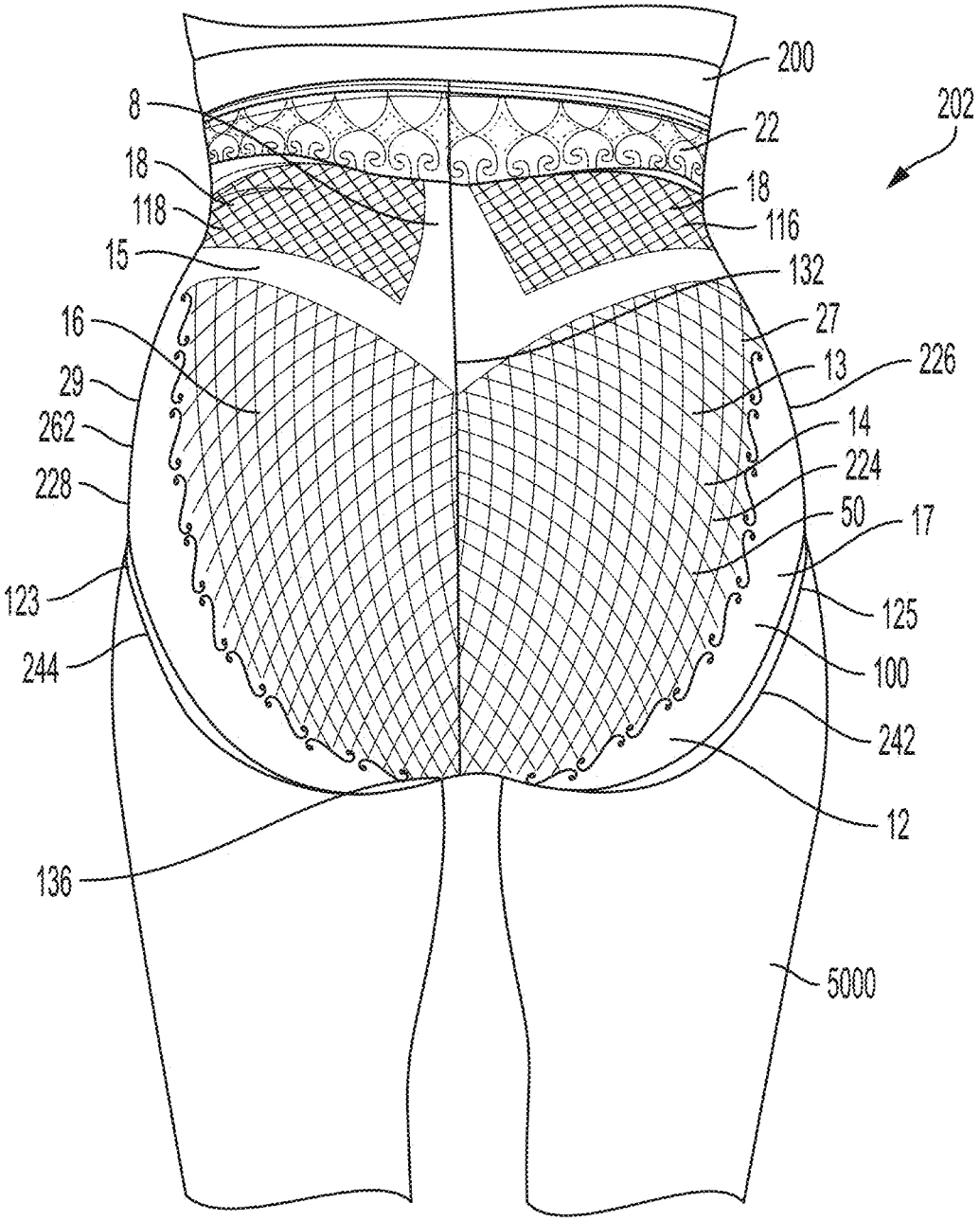
FIG. 3 is a rear view of the high waist brief of FIG. 2, the high waist brief being inside-out on the wearer's body to show the interior thereof.

The first side edge portion 112 and second side edge portion 114, all shown in FIG. 1, form a single vertical center back seam 132 shown in FIG. 3. Referring again to the embodiment of FIG. 1, first side edge portion 112, second side edge portion 114, first bottom side edge portion 122, second bottom side edge portion 124, and middle edge portion 126, all attach to crotch piece 135.

In FIG. 1, the shape of the lining flat pattern of liner 100 has a shape to fit over at least a waist area, a hip area, a crotch area, a buttocks area and an abdomen portion or area of a wearer when assembled. The lining flat pattern of liner 100 has a flat, straight shape at top edge 103 of waist transition region 22. The lining flat pattern of liner 100 has a straight shape that tapers outward from a first side 127 of top edge 103 along a distance of waist transition region 22, super waist whittler region 8 and top buttocks surrounding region 15. At a location above buttocks region 13, the lining flat pattern of liner 100 has a convex curved shape along a distance of a portion of top buttocks surrounding region 15 and also along buttocks region 13 up to first bottom side edge portion 122. The lining flat pattern of liner 100 has a straight shape that tapers inward along first bottom side edge portion 122. The lining flat pattern of liner 100 has a convex curved shape extending from first bottom side edge portion 122 inward toward axis A and upward toward waist transition region 22 along a distance of bottom buttocks surrounding region 12 and side buttocks surrounding region 17. At a location where bottom buttocks surrounding region 12 meets first side hip region 27, the lining flat pattern of liner 100 has a concave curved shape that extends outward toward and up to middle edge portion 126. Middle edge portion 126 has a flat, straight shape.

The lining flat pattern of liner 100 has a shape that is a mirror image when folded along a vertical axis A so that the lining flat pattern of liner 100 has a straight shape that tapers outward from a second side 129 of top edge 103 along a distance of waist transition region 22, super waist whittler region 8 and top buttocks surrounding region 15. At a location above buttocks region 13, the lining flat pattern of liner 100 has a convex curved shape along a distance of a portion of top buttocks surrounding region 15 and also along buttocks region 13 up to second bottom side edge portion 124. The lining flat pattern of liner 100 has a straight shape that tapers inward along second bottom side edge portion 124. The lining flat pattern of liner 100 has a convex curved shape extending from second bottom side edge portion 124 inward toward axis A and upward toward waist transition region 22 along a distance of bottom buttocks surrounding region 12 and side buttocks surrounding region 17. At a location where side buttocks surrounding region 17 meets second side hip region 29, the lining flat pattern of liner 100 has a concave curved shape that extends outward toward and up to middle edge portion 126.

Abdominal region 10 is an area of fabric body 110 with an elastic component that stretches over an abdominal area and a crotch area of the wearer's body to offer shaping and support. First abdominal border region 24 and second abdominal border region 26 form two inwardly curved borders 150, 151 of abdominal region 10. First abdominal border region 24 and second abdominal border region 26 each has a mesh with a cross pattern, however, other pattern designs could be used.

Waist transition region 22 forms a straight border 152 of abdominal region 10. Abdominal region 10, first abdominal border region 24 and second abdominal border region 26 increase the ability to flatter, re-sculpt, streamline, reshape and smooth a wearer's body because these regions minimize protruding abdomen area bulges, and re-sculpts for more desirable torso curves. Abdominal region 10 stretches over the abdominal area and the crotch area so that any bulge above the top of the pubic area is flattened and/or minimized.

First side hip region 27 and second side hip region 29 each is an area of fabric body 110 with an elastic component that stretches over a side hip area offering reshaping and support. First side hip region 27 has a border shown in broken lines 25, 31, 39, 131, 133, 137 in FIG. 1 and second side hip region 29 has a border that is a mirror image when fabric body is folded along axis A. First side hip region 27 is on a side of first abdominal border region 24 opposite abdominal region 10. Second side hip region 29 is on a side of second abdominal border region 26 opposite abdominal region 10. First side hip region 27 and second side hip region 29 reshape the hip area to minimize or flatten this area. First side hip region 27 and second side hip region 29 are free of seams and creates the ability to re-sculpt and reshape the wearer's body while eliminating any side seams thickness, bulges and visibility.

Side buttocks surrounding region 17, bottom buttocks surrounding region 12 and top buttocks surrounding region 15 are an area of fabric body 110 with an elastic component that stretches over a portion of a buttocks area on a top of the buttocks, on a side of the buttocks and underneath the buttocks of the wearer's body to offer reshaping, support and butt lift. Buttocks region 13 has a first buttocks section 14 and a second buttocks section 16. As shown in broken lines 21, 23, 35, 25 side buttocks surrounding region 17 and, as shown in broken lines 33, 35, 34, bottom buttocks surrounding region 12, respectively, form a convex curved border 34 with first buttocks section 14. Also, side buttocks surrounding region 17 and bottom buttocks surrounding region 12 form a convex curved border 35 of second buttocks section 16 that is a mirror image of the borders with first buttocks section 14. As shown in broken lines 37, 39, 41, top buttocks surrounding region 15 forms an inwardly sloping border 36 of first buttocks section 14 and second buttocks section 16 has an inwardly sloping border 36 that is a mirror image of inwardly sloping border 36 of first buttocks section 14. Inwardly sloping border 36 slope down to center vertical axis A.

As shown by a broken line 37, top buttocks surrounding region 15 borders super waist whittler region 8 and waist whittler region 18 up to broken line 39. Top buttocks surrounding region 15 has borders that are a mirror image of broken line 37 and broken line 39 along second buttocks section 16. As discussed above, top buttocks surrounding region 15 also forms an inwardly sloping border 36 of first buttocks section 14 and second buttocks section 16 has an inwardly sloping border 36 that is a mirror image of inwardly sloping border 36 of first buttocks section 14. Side buttocks surrounding region 17 is bordered by first buttocks section 14 at broken line 21, first side hip region 27 at broken line 31 and broken line 25, and first leg hole portion 123 at broken line 33 up until bottom buttocks surrounding region 12 at broken line 35 and side buttocks surrounding region 17 has borders that are a mirror image at second buttocks section 16, second leg hole portion 125 and second side hip region 29. Bottom buttocks surrounding region 12 is bordered at first buttocks section 14 at broken line 23 and at first leg hole portion 123 at broken line 33 up until side buttocks surrounding region 17 at broken line 35 and bottom buttocks surrounding region 12 has borders that are a mirror image at second buttocks section 16 and second leg hole portion 125 up until side buttocks surrounding region 17.

Side buttocks surrounding region 17, bottom buttocks surrounding region 12, top buttocks surrounding region 15, super waist whittler region 8, first side hip region 27 and second side hip region 29 visually appear to be the same material. However, top buttocks surrounding region 15 and bottom buttocks surrounding region 12 stretch in different directions than side buttocks surrounding region 17, super waist whittler region 8, first side hip region 27 and second side hip region 29. Top buttocks surrounding region 15 and bottom buttocks surrounding region 12 have portions that stretch in a primarily 45 degree direction relative to axis A.

Side buttocks surrounding region 17, super waist whittler region 8, first side hip region 27 and second side hip region 29 have portions that stretch in a primary direction that is parallel with axis A. Top buttocks surrounding region 15 and bottom buttocks surrounding region 12 stretch in different directions than side buttocks surrounding region 17, super waist whittler region 8, first side hip region 27 and second side hip region 29 and thus result in top buttocks surrounding region 15 and bottom buttocks surrounding region 12 having a different modulus than side buttocks surrounding region 17, super waist whittler region 8, first side hip region 27 and second side hip region 29. Bottom buttocks surrounding region 12 and top buttocks surrounding region 15 are both measured on 45 degree angle, which is relevant for the "butt lift".

Buttocks region 13 is an area of fabric body 110 with an elastic component that stretches over a buttocks area of the wearer's body to offer reshaping and support. Buttocks region 13 has an elasticity that is higher than side buttocks surrounding region 17, bottom buttocks surrounding region 12, and top buttocks surrounding region 15. Buttocks region 13 has an elongation, extension, or elasticity that is higher than side buttocks surrounding region 17, bottom buttocks surrounding region 12, and top buttocks surrounding region 15 and, thus, allows for the natural curve of the wearer's buttocks to extend into buttocks region 13 and creates a lifting effect, "butt lift", of the wearer's buttocks while the area of the wearer's body surrounding the wearer's buttocks is compressed at a higher modulus than buttocks region 13. Buttocks region 13 can be mesh of an open net construction that allows mesh area to stretch and contour the buttocks as well as allows passage of air and water (pool, sea, lake). FIG. 1 shows one type of mesh construction; however, other mesh constructions can be used.

Waist whittler region 18 has a first waist section 116 and a second waist section 118. Waist whittler region 18 is on sides of first abdominal border region 24 and second abdominal border region 26 opposite abdominal region 10. First abdominal border region 24 forms a curved border 160 of first waist section 116. Second abdominal border region 26 forms a curved border 180 of second waist section 118. Waist transition region 22 forms straight borders 162, 182 of both first waist section 116 and second waist section 118. Top buttocks surrounding region 15 forms concave curved borders 166, 186 on another side of each of first waist section 116 and second waist section 118. First side hip region 27 and second side hip region 29 forms concave curved borders 167, 187 of each of first waist section 116 and second waist section 118. Super waist whittler 8 forms straight borders 169, 189 of each of first waist section 116 and second waist section 118. Waist whittler region 18 is an area of fabric body 110 with an elastic component that stretches over an area above the high hips around the waistline of the wearer's body to offer reshaping, control and support. Along with abdominal region 10, first abdominal border region 24 and second abdominal border region 26, waist whittler region 18 increases the ability to flatter, re-sculpt, streamline, reshape and smooth a wearer's body because these regions minimize, reshape and re-sculpt for more desirable torso and waist curves. Waist region 18 has an opaque diamond pattern and is preferable in this region but could have another pattern design engineered to perform the same way in terms of elongation and control as stated in FIG. 17.

Waist transition region 22 is above waist whittler region 18, first abdominal border region 24, second abdominal border region 26, super waist whittler region 8 and abdominal region 10. Waist transition region 22 is included in a liner for one-piece swimsuits and high waisted garments or forms a high waisted garment, for example, high waisted underwear brief. Waist transition region 22, along with abdominal region 10, first abdominal border region 24, second abdominal border region 26 and waist whittler region 18, increases the ability to flatter, re-sculpt, streamline, reshape and smooth a wearer's body because it minimizes, reshapes and re-sculpts for more desirable torso curves. If liner 100 is connected to a bra top or bust support, waist transition region 22 provides a transition to the bra top or bust support. Accordingly, waist transition zone 22 extends to the underbust of the wearer to eliminate or minimize a bulge referred to as a "muffin top", and smooths a silhouette along that extant in, for example, a one-piece swimsuit and or garment incorporating liner 100 having a high waist. Waist transition region 22 minimizes visibility of different stretch power constructions of the eleven regions, while smoothing curves of a wearer's body and providing overall comfort. Waist transition region 22 has a diamond with dot and swirl pattern, but could have another pattern design engineered to perform the same way.

Fabric body 110 of liner 100 has a material comprising, for example, nylon or polyester and spandex, or other spandex and synthetic fiber combinations. For example, the material of fabric body 110 is greater than 20% spandex and less than 80% nylon. Preferably, fabric body 110 has a material that is more than 30% spandex, and less than 70% nylon. The material of fabric body 110 is warp knit or circular knit. Fabric body 110 is a material that can be breathable, supple and soft. The material can include an anti-microbial finish or yarn and can have chlorine resist yarns or properties.

The knit patterns formed in the material of abdominal region 10, first abdominal border region 24, second abdominal border region 26, buttocks region 13, bottom buttocks surrounding region 12, top buttocks surrounding region 15, side buttocks surrounding region 17, first side hip region 27, second side hip region 29, waist whittler region 18, super waist whittler region 8, and waist transition region 22 can differ due to aesthetic desire or performance needs. The patterning of each region is determined by both performance (elongation and modulus) requirements for reshaping in specific body areas and that individual patterning is also determined by differentiating aesthetics. Creating regions that have borders that can be curvilinear are included in the designing of alternative patterns with consideration for designs that have a desirable feeling, and distinctive and differentiating patterning.

Fabric body 110 has vertical axis A extending in a vertical direction from waist transition region 22 toward abdomen region 10, and a horizontal axis B extending in a horizontal direction perpendicular to vertical axis A. Each of abdominal region 10, first abdominal border region 24, second abdominal border region 26, buttocks region 13, bottom buttocks surrounding region 12, top buttocks surrounding region 15, side buttocks surrounding region 17, waist whittler region 18, super waist whittler region 8, first side hip region 27, second side hip region 29 and waist transition region 22, has an elasticity along vertical axis A and an elasticity along horizontal axis B.

Referring to FIGS. 17-18C-3, tests were performed on the flat panel of liner 100 of FIG. 1 resulting in the data of Table 1 in FIGS. 17-18C. The flat panel of liner 100 of FIG. 1 for sizes 8, 10 and 12 was measured and the flat panel of liner 100 of FIG. 1 for sizes 14, 16 and 18 was measured, and the results were averaged for rows 3-12 and 15 of Table 1. Row 13 of Table 1 includes measurements of flat panel of liner 100 of FIG. 1 for sizes 8, 10 and 12 for abdominal region 10 and row 14 of Table 1 includes measurements of flat panel of liner 100 of FIG. 1 for sizes 14, 16 and 18 for abdominal region 10. The column "Region" identifies the ten of the eleven regions that resulted in the measurements in the corresponding row of Table 1. The phrase "W on the body" in Table 1 has the width direction around the body of a wearer of the material of the region. Column C in Table 1 has measurements of an elongation in the width direction around the body of a wearer of the material of the region of the flat panel of liner 100. Elongation is defined as the ratio of the extension of a test specimen to its initial length, expressed as a percentage. Columns E, F, H, I, K, L, N, O, Q and R provide ranges of the measurements given in column C as set forth in Table 1. The phrase "L on the body" in Table 1 indicates the length direction on the body of the wearer of the material of the region. Column S in Table 1 includes measurements of an elongation in the length direction on the body of a wearer of the material of the region of the flat panel of liner 100. Columns U, V, X, Y, AA, AB, AD, AE, AG and AH provide ranges of the measurements given in column S in Table 1. Column AI includes measurements of a modulus @ 30% in the width direction around the body of the regions of the flat panel of liner 100. Modulus is defined as the pounds of Force (lbf) measured at a given amount of elongation. Columns AK, AL, AN, AO, AQ, AR, AT, AU, AW and AX provide ranges of the measurements given in Column AI in Table 1. Column AY in Table 1 includes measurements of a modulus @ 30% in the length direction on the body the regions of the flat panel of liner 100. Columns BA, BB, BD, BE, BG, BH, BJ, BK, BM and BN provide ranges of the measurements given in Column AY in Table 1. Column BO in Table 1 includes measurements of elongation at 45° on the body of the flat panel of liner 100. Columns BQ, BR, BT, BU, BW, BX, BZ, CA, CC, and CD provide ranges of the measurements given in column BO in Table 1. Column CE in Table 1 includes measurements of modulus @ 30% at 45° on the body of the flat panel of liner 100. Columns CG, CH, CJ, CK, CM, CN, CP, CQ, CS and CT provide ranges of the measurements given in Column CE. Column CU in Table 1 includes measurements of elongation at 15° on the body of the flat panel of liner 100. Columns CW, CX, CZ, DA, DC, DD, DF, DG, DI and DJ provide ranges of the measurements given in Column CU. Column DK in Table 1 includes measurements of modulus @30% at 15° on the body of the flat panel of liner 100. Columns DM, DN, DP, DQ, DS, DT, DB, DW, DY and DZ provide ranges of the measurements given in Column DK. The letter "x" in Table 1 indicates a measurement was not taken. For all regions except bottom buttocks surrounding region 12 and top buttocks surrounding region 15, the letter "x" in Table 1 indicates a measurement was not taken because a measurement could not be taken according to the standard test method due to the small size of the specimen.

Data of elongation and modulus provided in Table 1 are the results of testing on a Zwick/Roell Model KAP-Z machine that is a CRE (Constant Rate of Extension) machine. The method used was ASTM D4964. Specimens in this method may be tested in either a loop or strip. The specimens tested were tested as a strip rather than loop. Specimens from ten of the eleven regions were tested. The Zwick/Roell Model KAP-Z machine generates a graph having a first axis showing pounds of force, and a second axis that shows a percentage of elongation. At specific points on the elongation curve, the modulus numbers are recorded. Table 1 includes a measurement at 30% elongation that is a measurement point employed in the test method in accordance with ASTM D4964. Table 1 also includes modulus numbers having a number of pounds of force needed to obtain 30% elongation. The specimens tested of the flat panel of liner 100 were 69% nylon 31% Lycra spandex.

In at least one embodiment, the material of abdominal region 10 for sizes 8, 10 and 12 has an elongation in the width direction around the body of 115 percent, and a modulus @ 30% in the width direction around the body of 1.14, and an elongation in the length direction on the body of 136 percent and a modulus @ 30% in the length direction on the body of 0.81.

In at least one embodiment, the material of abdominal region 10 for sizes 14, 16 and 18 has an elongation in the width direction around the body of 117 percent, and a modulus @ 30% in the width direction around the body of 0.98, and an elongation in the length direction on the body of 130 percent and a modulus @ 30% in the length direction on the body of 0.90.

In at least one embodiment, the material of abdominal region 10 that averages the measurements for sizes 8, 10 and 12 and sizes 14, 16 and 18 has a modulus @ 30% in the width direction around the body of 1.06, and a modulus @ 30% in the length direction on the body of 0.855.

In at least one embodiment, the material of first side hip region 27 and second side hip region 29 has an elongation in the width direction around the body of 139 percent, and a modulus @ 30% in the width direction around the body of 0.86, and an elongation in the length direction on the body of 116 percent and a modulus @ 30% in the length direction on the body of 1.60.

In at least one embodiment, the material of super waist whittler 8 has an elongation in the width direction around the body of 128 percent, and a modulus @ 30% in the width direction around the body of 1.11, and an elongation in the length direction on the body of 150 percent and a modulus @30% in the length direction on the body of 0.67.

In at least one embodiment, the material of side buttocks surrounding region 17 has an elongation in the length direction on the body of 119 percent and a modulus @ 30% in the length direction on the body of 1.41.

In at least one embodiment, the material of bottom buttocks surrounding region 12 has an elongation in the 45 degree direction on the body of 105.5 percent and a modulus @ 30% in the 45 degree direction on the body of 1.69.

In at least one embodiment, the material of top buttocks surrounding region 15 has an elongation in the 45 degree direction on the body of 167 percent and a modulus @ 30% in the 45 degree direction on the body of 0.38.

In at least one embodiment, the material of top buttocks surrounding region 15 has an elongation in the 15 degree direction on the body of 150 percent and a modulus @ 30% in the 15 degree direction on the body of 0.72.

In at least one embodiment, the material of buttocks region 13 has an elongation in the width direction around the body of 177 percent, and a modulus @ 30% in the width direction around the body of 0.53, and an elongation in the length direction on the body of 175 percent and a modulus @30% in the length direction on the body of 0.41. Buttocks region 13 has an elasticity that is greater than the other regions, namely, abdominal region 10, first abdominal border region 24 and second abdominal border region 26, bottom buttocks surrounding region 12, top buttocks surrounding region 15, side buttocks surrounding region 17, first side hip region 27 and second side hip region 29, super waist whittler region 8, waist whittler region 18 and waist transition region 22.

In at least one embodiment, the material of waist whittler region 18 has an elongation in the width direction around the body of 160 percent and a modulus @ 30% in the width direction around the body of 0.57.

In at least one embodiment, the material of waist transition region 22 has an elongation in the width direction around the body of 133 percent and a modulus @ 30% in the width direction around the body of 0.72.

In at least one embodiment, the material of first abdominal border region 24 and second abdominal border region 26 has an elongation in the length direction on the body of 149 percent and a modulus @ 30% in the length direction on the body of 0.57.

Accordingly, top buttocks surrounding region 15 and bottom buttocks surrounding region 12 reshape the body above and below buttocks region 13 to minimize or flatten this area, whereas buttocks region 13 having an elongation and elasticity that is more than top buttocks surrounding region 15 and bottom buttocks surrounding region 12 allows for the natural curve of the wearer's buttocks to extend into buttocks region 13 and creates a lifting effect of the wearer's buttocks while the area of the wearer's body surrounding the wearer's buttocks is compressed at more modulus than buttocks region 13.

Figure 2:
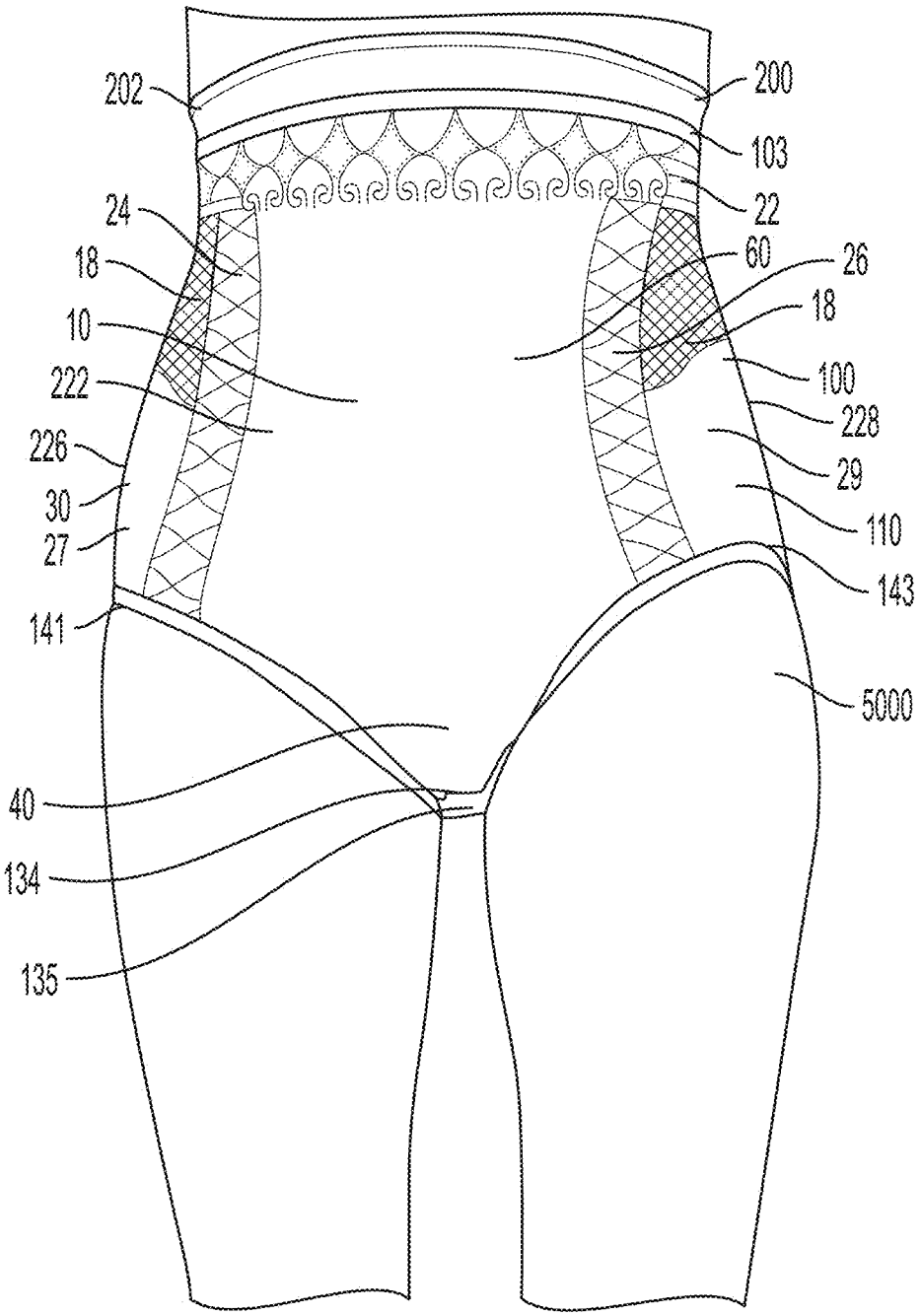
FIG. 2 is a front view of the liner of FIG. 1 in an assembled configuration connected to an outer shell forming a high waist brief, the high waist brief being inside-out on a wearer's body to show the interior thereof.
Figure 4:
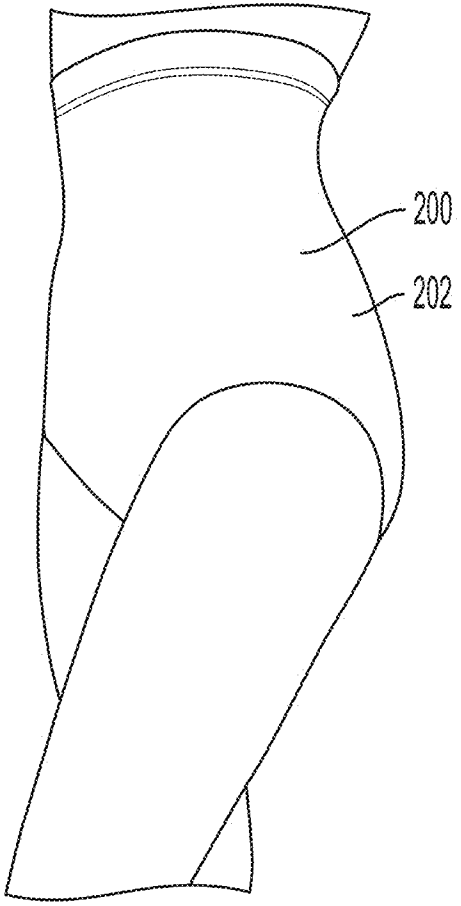
FIG. 4 is a front perspective view of the high waist brief of FIG. 2, the high waist brief being on the wearer's body to show the exterior thereof.

Referring to FIG. 2, liner 100 is in an assembled configuration connected to an outer shell 200 forming a high waist brief 202 shown on a wearer's body. High waist brief 202 is shown in FIG. 2 as inside-out relative to FIG. 4 to show as interior liner 100. Liner 100 has fabric body 110 that covers at least a side hip area 30, a crotch area 40, a buttocks area 50 (FIG. 3) and an abdomen portion or area 60 of a wearer 5000. Liner 100 is connected to outer shell 200. Liner 100 is connected to outer shell 200 at top edge 103 of liner 100. Top edge 103 connects to outer shell 200 by a seam. The seam can be a clean finish seam joining liner 100 to outer shell 200 at a waist. The seam can be a clean finish seam joining liner 100 to outer shell 200 at a waist with a clean finish seam with rubber in the clean finish seam. The rubber can be ¼ inch to 2 inches, and, ⅝ inches in one embodiment, for sizes 6-18 of high waist brief 202. The seam faces down towards crotch piece 135 and is a double needle top stitch forming a (one eighth inch gauge) seam. Outer shell 200 is a material, for example, tricot construction having 80 percent nylon and 20 percent spandex that hides liner 100 so that liner 100 is not visible when worn on the wearer as shown in FIG. 4. Outer shell 200 can also be other warp knit constructions, circular knit or woven construction.

As shown in FIG. 2, high waist brief 202 has a front horizontal seam 134, and, as shown in FIG. 3, a rear horizontal seam 136. Front horizontal seam 134 and rear horizontal seam 136 can each be sewn with a flatlock stitch. Front horizontal seam 134 and rear horizontal seam 136 connect first bottom side edge portion 122, second bottom side edge portion 124, and middle edge portion 126, all shown in FIG. 1, to crotch piece 135 forming leg holes 141, 143, as shown in FIGS. 2 and 3. Leg holes 141, 143 connect to outer shell 200 by seams with rubber. Front horizontal seam 134 connects middle edge portion 126, shown in FIG. 1, to a first side of crotch piece 135. Rear horizontal seam 136 connects first bottom side edge portion 122 and second bottom side edge portion 124, both shown in FIG. 1, to a second side crotch piece 135 that is opposite the first side. The two halves of liner 100 are sewn together at single vertical center back seam 132 and front horizontal seam 134 and rear horizontal seam 136 connect first bottom side edge portion 122, second bottom side edge portion 124, and middle edge portion 126, all shown in FIG. 1, to crotch piece 135 to close the crotch area and vertical center back seam 132. There is also clean finish sewing in the back of liner 100 and outer shell 200 that catches single vertical center back seam 132, front horizontal seam 134 and rear horizontal seam 136 and so it engages and maintains the butt lift.

The clean finish sewing of liner 100 and outer shell 200 is described referring to FIG. 19. Outer shell 200 is connected to liner 100 by first attaching crotch piece 135 (FIG. 1) to middle edge portion 126 forming front horizontal seam 134 (FIG. 1) as a flat lock seam. Liner 100 and outer shell 200 are connected so that inside and outside of a garment have a clean finished seam. To form the clean finished seam, a fold line is formed at the location of axis A shown in FIG. 1 in liner 100 so that first side edge portion 112 overlaps second side edge portion 114, both shown in FIG. 1, with right sides together and placed down on a sewing machine. The right side refers to a side of material that will be exposed when the material is a part of a finished garment. Outer shell 200 is similarly sized and shaped as liner 100. Outer shell 200 is similarly folded as liner 100 so that a first side edge portion 212 overlaps a second side edge portion 214 right sides together. Outer shell 200 that has been folded is placed down on liner 100 that has been folded so that four ply of fabric are on top of one another. The four plies of fabric are sewn forming a center back seam 2002 with a four thread mock safety stitch from top edge 103 to first bottom side edge portion 122 and a second bottom side edge portion 124 of liner 100 and from an outer top edge 204 to outer bottom side edges 206, 208 of outer shell. Center back seam 2002 also forms single vertical center back seam 132 of liner 100.

Referring to FIG. 20, outer shell 200 is turned inside out placing liner 100 inside of outer shell 200. Center back seam 2002 is opened at first bottom side edge portion 122, second bottom side edge portion 124 and outer bottom side edges 206, 208. Crotch piece 135 is connected to first bottom side edge portion 122, second bottom side edge portion 124 and outer bottom side edges 206, 208 along a rear horizontal seam 136. Rear horizontal seam 136 is a clean finish crotch seam. This clean finished center back seam with all 4 plies of fabric sewn together helps to further engage the butt lift feature. A "clean finish" seam creates a seam where one does not see any stitching on inside or outside of 2 seams that are sewn together.

Referring to FIG. 3, high waist brief 202 is shown as inside-out relative to FIG. 4 to shown as interior liner 100 in FIG. 3. High waist brief 202 having fabric body 110 of liner 100 and outer shell 200 has only a single vertical seam, namely, single vertical center back seam 132. Single vertical center back seam 132 passes through bottom buttocks surrounding region 12, buttocks region 13, top buttocks surrounding region 15, super waist whittler region 8, and waist transition region 22. Single vertical center back seam 132 connects first side edge portion 112 and second side edge portion 114, shown in FIG. 1, of fabric body 110. Single vertical center back seam 132 connects first buttocks section 14 and second buttocks section 16 together while also connecting first buttocks section 14 and second buttocks section 16 to first and second edge portions 212, 214 of outer shell 200 as shown in FIG. 19. Single vertical center back seam 132 becomes clean finished by sewing all 4 together as described herein. Single vertical center back seam 132 follows the natural separation in a wearer's buttocks forming a desirable reshaping and engages and maintains pull/push up of the butt lift feature and benefit. Single vertical center back seam 132 also accentuates the natural separation in the buttocks of the wearer.

As shown in FIG. 2, abdominal region 10 is the area of fabric body 110 with the elastic component that stretches over abdomen area 60 and crotch area 40 of the wearer's body 5000 to offer reshaping and support. Abdominal region 10, first abdominal border region 24 and second abdominal border region 26 increase an ability to flatter by re-sculpting, streamlining, reshaping and smoothing a wearer's body because they minimize shape and re-sculpt for more desirable torso curves. Abdominal region 10 stretches over the abdomen area 60 and the crotch area 40 so that a bulge above the pubic area on a woman's body is flattened or minimized. First abdominal border region 24 and second abdominal border region 26 separates abdominal region 10 from first side hip region 27 and second side hip region 29 for additional comfort while the wearer 5000 is wearing liner 100, as well as when the wearer 5000 takes liner 100 on and off.

Referring again to FIG. 2, first side hip region 27 and second side hip region 29 are areas of fabric body 110 with an elastic component that stretches over hip areas 30 offering reshaping and support. First side hip region 27 and second side hip region 29 shape hip areas 30 to minimize or flatten this area. First side hip region 27 and second side hip region 29 are free of seams as a preferable embodiment and increases the ability to re-sculpt and reshape the wearer's body and eliminates the side seam thickness, bulge and visibility.

Referring to FIG. 3, bottom buttocks surrounding region 12, top buttocks surrounding region 15, side buttocks surrounding region 17 are an area of fabric body 110 with an elastic component that stretches over a portion of buttocks area 50 on top, side and underneath the buttocks of the wearer's body to offer reshaping, support and butt lift. Buttocks region 13 is an area of fabric body 110 with an elastic component that stretches over buttocks area 50 of the wearer's body to offer reshaping and support. Buttocks region 13 has an elasticity that is more than bottom buttocks surrounding region 12, top buttocks surrounding region 15, side buttocks surrounding region 17. Buttocks region 13 has an elongation, extension, or elasticity that is more than bottom buttocks surrounding region 12, top buttocks surrounding region 15, side buttocks surrounding region 17 and thus allows for the natural curve of buttocks area 50 to extend into buttocks region 13 and creates a lifting effect, "butt lift", of buttocks area 50 while the area of the wearer's body surrounding buttocks area 50 is compressed at more modulus than buttocks region 13 by bottom buttocks surrounding region 12, top buttocks surrounding region 15, side buttocks surrounding region 17. This action allows buttocks tissue to spill into stretchier fabric in buttocks region 13 and help with creating a visual rounder/shapelier/re-sculpting of the top of the buttocks when the side plus bottom of the buttocks are being lifted by bottom buttocks surrounding region 12 and side buttocks surrounding region 17 that is being activated. Top buttocks surrounding region 15 is responsible for activating a pushing down of the top of the buttocks tissue that will spill down into the buttocks region 13.

As shown in FIG. 2, waist whittler region 18 is an area of fabric body 110 with an elastic component that stretches over an area above hip area 30 around the waistline of the wearer's body 5000 to offer reshaping, control and support. Along with abdominal region 10, first abdominal border region 24 and second abdominal border region 26, waist whittler region 18 increases the ability to flatter re-sculpting, streamlining, reshaping and smoothing a wearer's body because they minimize, reshape and re-sculpt for more desirable torso curves.

Referring to FIG. 3, super waist whittler 8 is located in center back between first waist region 116 and second waist region 118 of waist whittler region 18. Super waist whittler 8 gives more power for waist whittling.

Waist transition region 22, along with abdominal region 10, first abdominal border region 24, second abdominal border region 26 and waist whittler region 18, increase the ability to flatter a wearer's body because they re-sculpt, streamline, reshape and smooth for more desirable torso curves. Accordingly, waist transition region 22 extends to an underbust 66, shown in FIG. 2, of the wearer eliminating or minimizing a bulge referred to as a "muffin top" and smooths out a silhouette all the way up in to a high waist. Waist transition region 22 connects and unifies the multiple power constructions of the remaining regions below axis B in FIG. 1, while smoothing curves of a wearer's body and providing overall comfort.

Referring to FIG. 1, an entire leg hole opening of each of first leg hole portion 123 and second leg hole portion 125 on each side of liner 100, which includes the entire crotch piece 135, has metered elastic. Liner 100 creates a fold at first leg hole portion 123 surrounding a first segment of elastic. Liner 100 creates a fold at second leg hole portion 125 surrounding a second segment of elastic. Similarly, as shown in FIG. 3, outer shell 200 creates a first fold 242 around the fold formed by liner 100 at first leg hole portion 123 and the first segment of elastic and a second fold 244 around the fold formed by liner 100 at second leg hole portion 125 and the second segment of elastic. Stitching is through both layers of first fold 242, both layers of the fold formed by liner 100 at first leg hole portion 123 and the first segment of elastic. Stitching is through both layers of second fold 244, both layers of the fold formed by liner 100 at second leg hole portion 125 and the second segment of elastic.

Referring back to FIG. 1, the metering of the first segment of elastic and the second segment of elastic is not the same percentage around the entirety of first leg hole portion 123 and second leg hole portion 125, respectively. As shown by a line 170 that is a dash double dot line, beginning from imaginary side seam 171, going towards a direction of a front of liner 100, all the way through to crotch piece 135 and ending at rear horizontal seam 136 (FIG. 3), the first segment of elastic is metered approximately between 95 percent to 97 percent, which means there is a 3 percent to 5 percent decrease of a distance along line 170 of a flat original measurement on this segment of first leg hole portion 123 when the first segment of elastic is metered to be connected to liner 100 and the first segment of elastic is in a contracted condition. The first segment of elastic is not stretched in the contracted condition. As shown by a line 172 that is a dash single dot line, starting at the area from rear horizontal seam 136 (FIG. 3) and going up a back of a leg of wearer W, in a direction of imaginary side seam 171, the same elastic is metered at approximately 70%, which means a 30% decrease of a distance along line 172 of the original flat measurement on this segment of first leg hole portion 123 when the first segment of elastic is metered to be connected to liner 100 and the first segment of elastic is in a contracted condition. Second leg hole portion 125 has the same metering as first leg hole portion 123. Metering the elastic at the higher ratio, namely, approximately 70%, is important since this is one of the multiple mechanisms for uplifting the butt of wearer W in liner 100 as well with outer shell 200.

The butt lift occurs because of the strong diagonal modulus of bottom buttocks surrounding region 12 and top buttocks surrounding region 15, that in turn are due to the pulling lift of the first segment of elastic and the second segment of elastic that are both metered along line 172. For example, the first segment of elastic and the second segment of elastic each go all the way up to one of the imaginary side seams 171, respectively, in combination with the pattern shape that the back leg line is cut into the fabric of first leg hole portion 123 and a second leg hole portion 125. This combination lifts and raises the butt in the diagonal direction along the backside leg line.

At the area where the highest part of the leg line is located at the imaginary side seam 171, there is a bottom edge of first side hip region 27 and second side hip region 29. It is believed that first side hip region 27 and second side hip region 29 are not reacting in a diagonal direction because first side hip region 27 and second side hip region 29 now are in a length and width stretch direction due in part to the effect of liner 100 extending entirely around body W of wearer at first side hip region 27 and second side hip region 29 forming "360 degrees around the body coverage".

In contrast, liner 100 does not extend entirely around body 5000 of wearer at bottom buttocks surrounding region 12. Also, liner 100 does not work in a "360 degrees around body coverage" because liner 100 is "interrupted" at bottom buttocks surrounding region 12 by the uncovered thigh at first leg hole portion 123 and second leg hole portion 125 making coverage by liner 100 less than 360 degrees. In comparison, liner 100 forms "360 degrees around the body coverage" by side buttocks surrounding region 17, buttocks region 13, first abdominal border region 24, second abdominal border region 26, abdominal region 10, first side hip region 27 and second side hip region 29, with all connected to extend entirely around body W of wearer.

Top buttocks surrounding region 15 works on body W of wearer due to vertical center back seam 132 that is curved thereby turning fabric of top buttocks surrounding region 15 into a severe mitered area when on the body, visually shown in FIG. 3. Top buttocks surrounding region 15 has a pull, that is a strong diagonal modulus. Further, the pull works against the skin of the body by pushing down over the buttocks region 13, which has more stretch and lower modulus, to allow the softer butt tissue of body W of wearer to be compacted with a combination push/pull motion from bottom buttocks surrounding region 12 and top buttocks surrounding region 15 working together to mold, shape and lift the buttocks. As shown in Table 2 below for high waist brief 202, buttocks region 13 has the lowest modulus @ 30% in the length direction on the body and width direction around the body of those regions that were measured as discussed herein and shown in FIGS. 17-18C.

Referring to Table 2 for high waist brief 202, the values for "% higher than Buttocks region 13 for L ON BODY—modulus @ 30%" were calculated by calculating the difference between the values given in the column "L ON BODY—modulus @ 30%" for buttocks region 13 and another of the regions and dividing by the value given in the column "L ON BODY—modulus @30%" for buttocks region 13. The values for "% higher than Buttocks region 13 for W ON BODY—modulus @ 30%" were calculated by calculating the difference between the values given in the column "W ON BODY—modulus @30%" for buttocks region 13 and another of the regions and dividing by the value given in the column "W ON BODY—modulus @ 30%" for buttocks region 13.

In particular, side buttocks surrounding region 17 has a modulus @30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @30% in the width direction around the body that is equal to or greater than 62% more than buttocks region 13. Waist whittler region 18 has a modulus @ 30% in the width direction around the body that is equal to or greater than 7.5% more than buttocks region 13. Waist transition region 22 has a modulus @ 30% in the width direction around the body that is equal to or greater than 36% more than buttocks region 13. Super waist whittler region 8 has a modulus @ 30% in the length direction on the body that is equal to or greater than 63% more than buttocks region 13 and the width direction around the body that is equal to or greater than 109% more than buttocks region 13. Abdominal region 10 has a modulus @ 30% in the length direction on the body that is equal to or greater than 108% more than buttocks region 13 and the width direction around the body that is equal to or greater than 100% more than buttocks region 13. First abdominal border region 24 and second abdominal border region 26 have a modulus @ 30% in the length direction on the body that is equal to or greater than 39% more than buttocks region 13.

In addition, as shown in Table 2 below, abdominal region 10 and super waist whittler region 8 have the highest modulus in the width direction around the body to offer shaping and support. Moreover, abdominal region 10 has a modulus in the length direction on the body that is higher than some of the other regions to offer further shaping and support. The values for "% lower (–) or % higher (+) than Abdominal region 10 for L ON BODY—modulus @ 30%" were calculated by calculating the difference between the values given in the column "L ON BODY—modulus @ 30%" of abdominal region 10 and another of the regions and dividing by the value given in the column "L ON BODY—modulus @30%" for abdominal region 10. The values for "% lower (–) or % higher (+) than Abdominal region 10 for W ON BODY—modulus @ 30%" were calculated by calculating the difference between the values given in the column "W ON BODY—modulus @ 30%" of abdominal region 10 and another of the regions and dividing by the value given in the column "W ON BODY—modulus @ 30%" for abdominal region 10.

In particular, side buttocks surrounding region 17 has a modulus @30% in the length direction on the body that is greater than 65% more than abdominal region 10. First side hip region 27 and second side hip region 29 have a modulus @ 30% in the length direction on the body that is equal to or greater than 87% more than abdominal region 10 and a modulus @ 30% in the width direction around the body that is equal to or greater than 19% lower than abdominal region 10. Waist whittler region 18 has a modulus @ 30% in the width direction around the body that is equal to or greater than 46% lower than abdominal region 10. Waist transition region 22 has a modulus @ 30% in the width direction around the body that is equal to or greater than 32% lower than abdominal region 10. Super waist whittler region 8 has a modulus @ 30% in the length direction on the body that is equal to or greater than 21% less than abdominal region 10 and the width direction around the body that is equal to or greater than 4.7% more than abdominal region 10. Buttocks region 13 has a modulus @ 30% in the length direction on the body that is equal to or greater than 52% less than abdominal region 10 and the width direction around the body that is equal to or greater than 100% less than abdominal region 10. First abdominal border region 24 and second abdominal border region 26 have a modulus @ 30% in the length direction on the body that is equal to or greater than 33% less than abdominal region 10.

TABLE 2

FIGS. 2 and 3-HIGH WAIST BRIEF

| REGION | L ON BODY-modulus @ 30% | W ON BODY-modulus @ 30% | 45° ANGLE-modulus @ 30% | 15° ANGLE-modulus @ 30% | % higher than Buttocks region 13 for L ON BODY-modulus @ 30% | % higher than Buttocks region 13 for W ON BODY-modulus @ 30% | % lower (−) or % higher (+) than Abdominal region 10 for L ON BODY-modulus @ 30% | % lower (−) or % higher (+) than Abdominal region 10 for W ON BODY-modulus @ 30% |
|---|---|---|---|---|---|---|---|---|
| Buttocks region 13 | 0.41 | 0.53 | | | | | −52% | −100% |
| Bottom Buttocks surrounding region 12 | | | 1.69 | | | | | |
| Side Buttocks surrounding region 17 | 1.41 | | | | 244% | | +65% | |
| First Side Hip region 27, Second Side Hip region 29 | 1.6 | 0.86 | | | 290% | 62% | +87% | −19% |
| Waist Whittler 18 | | 0.57 | | | | 7.5% | | −46% |
| Top Buttocks surrounding region 15 | | | 0.38 | 0.72 | | | | |
| Waist Transition region 22 | | 0.72 | | | | 36% | | −32% |
| Super Waist Whittler 8 | 0.67 | 1.11 | | | 63% | 109% | −21% | +4.7% |
| Abdominal region 10 | 0.855 | 1.06 | | | 108% | 100% | | |
| First Abdominal border region 24, Second Abdominal border region 26 | 0.57 | | | | 39% | | −33% | |

Figure 5:
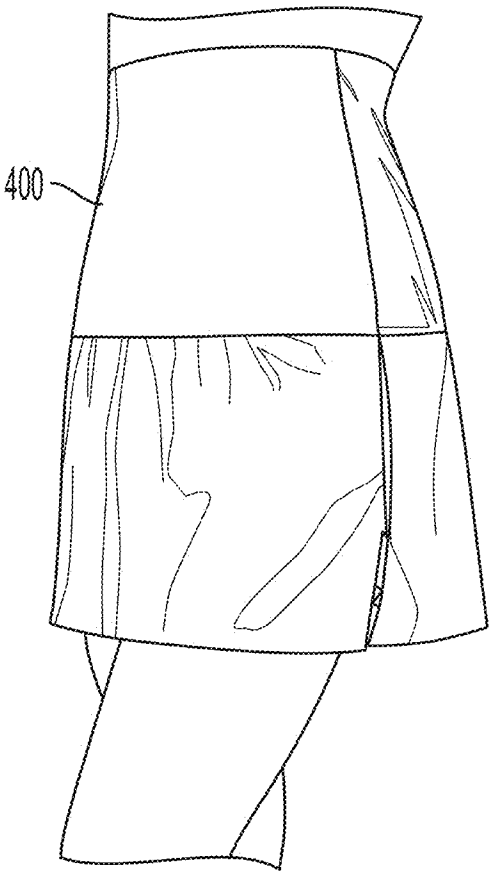
FIG. 5 is a front perspective view of the high waist brief of FIG. 2, the high waist brief being on the wearer's body to show the exterior thereof and being connected to a skirt.

Referring to FIG. 4, high waist brief 202 that is shown in FIGS. 2 and 3 has liner 100 that is shown in FIGS. 2 and 3 and outer shell 200 that is shown in FIGS. 2 to 4, and can be connected to a skirt portion 400 that is shown in FIG. 5 or a shorts portion (not shown). Skirt portion 400 can be cut to the mid hip of the wearer.

Alternatively, high waist brief 202 can have only a front portion 222 of liner 100 that is the portion shown in FIG. 2. In this modification or embodiment of liner 100, front portion 222 is connected to outer shell 200 by two side seams on opposite sides 226, 228 of front portion 222. A rear portion 224 of liner 100 shown in FIG. 3 is not included in this modification of liner 100. High waist brief 202 can include, but is not limited to, shorts, skirt, for example, as shown in FIG. 5.

In this modification of liner 100, front portion 222 provides the functionality of the regions present as discussed for liner 100, namely, abdominal region 10, first abdominal border region 24 and second abdominal border region 26. Front portion 222 also provides functionality of regions that are partially present, namely, waist whittler region 18, first side hip region 27 and second side hip region 29, and waist transition region 22. The portions of first side hip region 27 and second side hip region 29 in front portion 222 stretches over a portion of hip area 30 offering shaping and support to minimize or flatten this area. The portions of waist whittler region 18 in front portion 222 stretch over a portion of the wearers body 5000 above hip area 30 around the waistline of the wearer's body 5000 to offer reshaping, control and support. Along with abdominal region 10, first abdominal border region 24 and second abdominal border region 26, the portions of waist whittler region 18 increase ability to flatter, re-sculpt, streamline, reshape and smooth a wearer's body because it minimizes, reshapes and re-sculpts for more desirable torso curves. As with the other embodiments discussed above, the portion of waist transition region 22 present in front portion 222, along with abdominal region 10, first abdominal border region 24, second abdominal border region 26 and the portion of waist whittler region 18, increases the ability to flatter, re-sculpt, streamline, reshape and smooth a wearer's body because they minimize reshape and re-sculpt for more desirable torso curves. Waist transition region 22 connects and unifies the multiple power constructions of the remaining regions below axis B in FIG. 1, while smoothing curves of a wearer's body and providing overall comfort. As shown in Table 3 below for the front of high waist brief 202, abdominal region 10 has a modulus @ 30% in the width direction around the body that is equal to or greater than 46% higher than waist whittler 18 and equal to or greater than 46% higher than first side hip region 27 and second side hip region 29.

TABLE 3

FIG. 2-HIGH WAIST BRIEF FRONT

| REGION | W ON BODY-modulus @ 30% | % lower (−) or % higher (+) than Abdominal region 10 for W ON BODY-modulus @ 30% |
|---|---|---|
| Abdominal region 10 | 1.06 | — |
| First Abdominal border region 24, Second Abdominal border region 26 | | |
| First Side Hip region 27, Second Side Hip region 29 | 0.86 | 19% |
| Waist Whittler 18 | 0.57 | 46% |

Referring again to FIG. 3, another embodiment or modification of high waist brief 202 that has only rear portion 224 of liner 100 as shown. In this modification, rear portion 224 is connected to outer shell 200 by two side seams on opposite sides 226, 228 of rear portion 224. A front portion 222 of liner 100 shown in FIG. 2 is not included in this modification of liner 100. In this modification of liner 100, a typical tummy control panel, for example, a panel comprising the material of only abdominal region 10, can replace front portion 222 of liner 100.

Also in this modification of liner 100, rear portion 224 provides the functionality of the regions present as discussed for liner 100, namely, buttocks region 13, super waist whittler region 8, top buttocks surrounding region 15, side buttocks surrounding region 17 and bottom buttocks surrounding region 12. Rear portion 224 also provides partial functionality of regions that are partially present, namely, waist whittler region 18, first side hip region 27 and second side hip region 29, and waist transition region 22. The portion of first side hip region 27 and second side hip region 29 in rear portion 224 stretches over a portion of hip area 30 offering reshaping and support to minimize or flatten this area. The portions of waist whittler regions 18 in rear portion 224 stretch over portions of the wearers body 5000 above hip area 30 around the waistline of the wearer's body 5000 to offer reshaping, control and support. In this embodiment as well, the portions of waist whittler region 18 increase the ability to flatter, re-sculpt, streamline, reshape and smooth a wearer's body because it minimizes, reshapes and re-sculpts for more desirable torso curves. Waist transition region 22 and the portions of waist whittler region 18 increase the ability to flatter, re-sculpt, streamline, reshape and smooth a wearer's body because they minimize reshape and re-sculpt for more desirable torso curves. Accordingly, waist transition region 22 extends up to high waist of the wearer to eliminate or minimize a bulge referred to as a "muffin top" where it covers the wearer's body 5000 and smooths out lumps and bumps all the way up in to a high waist. Waist transition region 22 connects and unifies the multiple power constructions of the remaining regions below axis B in FIG. 1, while smoothing curves of a wearer's body and providing overall comfort.

As shown in Table 4 below for the rear of high waist brief 202, buttocks region 13 has the lowest modulus @ 30% in the length direction on the body and width direction around the body of those regions that were measured. In particular, side buttocks surrounding region 17 has a modulus @ 30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @ 30% in the width direction around the body that is equal to or greater than 62% more than buttocks region 13. Waist whittler region 18 has a modulus @ 30% in the width direction around the body that is equal to or greater than 7.5% more than buttocks region 13. Waist transition region 22 has a modulus @ 30% in the width direction around the body that is equal to or greater than 36% more than buttocks region 13. Super waist whittler region 8 has a modulus @ 30% in the length direction on the body that is equal to or greater than 63% more than buttocks region 13 and the width direction around the body that is equal to or greater than 109% more than buttocks region 13.

TABLE 4

FIG. 3-HIGH WAIST BRIEF REAR

| REGION | L ON BODY-modulus @ 30% | W ON BODY-modulus @ 30% | 45° ANGLE-modulus @ 30% | % lower than Buttocks region 13 for L ON BODY-modulus @ 30% | % lower than Buttocks region 13 for W ON BODY-modulus @ 30% |
|---|---|---|---|---|---|
| Buttocks region 13 | 0.41 | 0.53 | | | |
| Bottom Buttocks surrounding region 12 | | | 1.69 | | |
| Side Buttocks surrounding region 17 | 1.41 | | | 244% | |
| First Side Hip region 27, Second Side Hip region 29 | 1.6 | 0.86 | | 290% | 62% |
| Waist Whittler 18 | | 0.57 | | | |
| Top Buttocks surrounding region 15 | | | 0.38 | | 7.5% |
| Waist Transition region 22 | | 0.72 | | | 36% |
| Super Waist Whittler 8 | 0.67 | 1.11 | | 63% | 109% |

Figure 6:
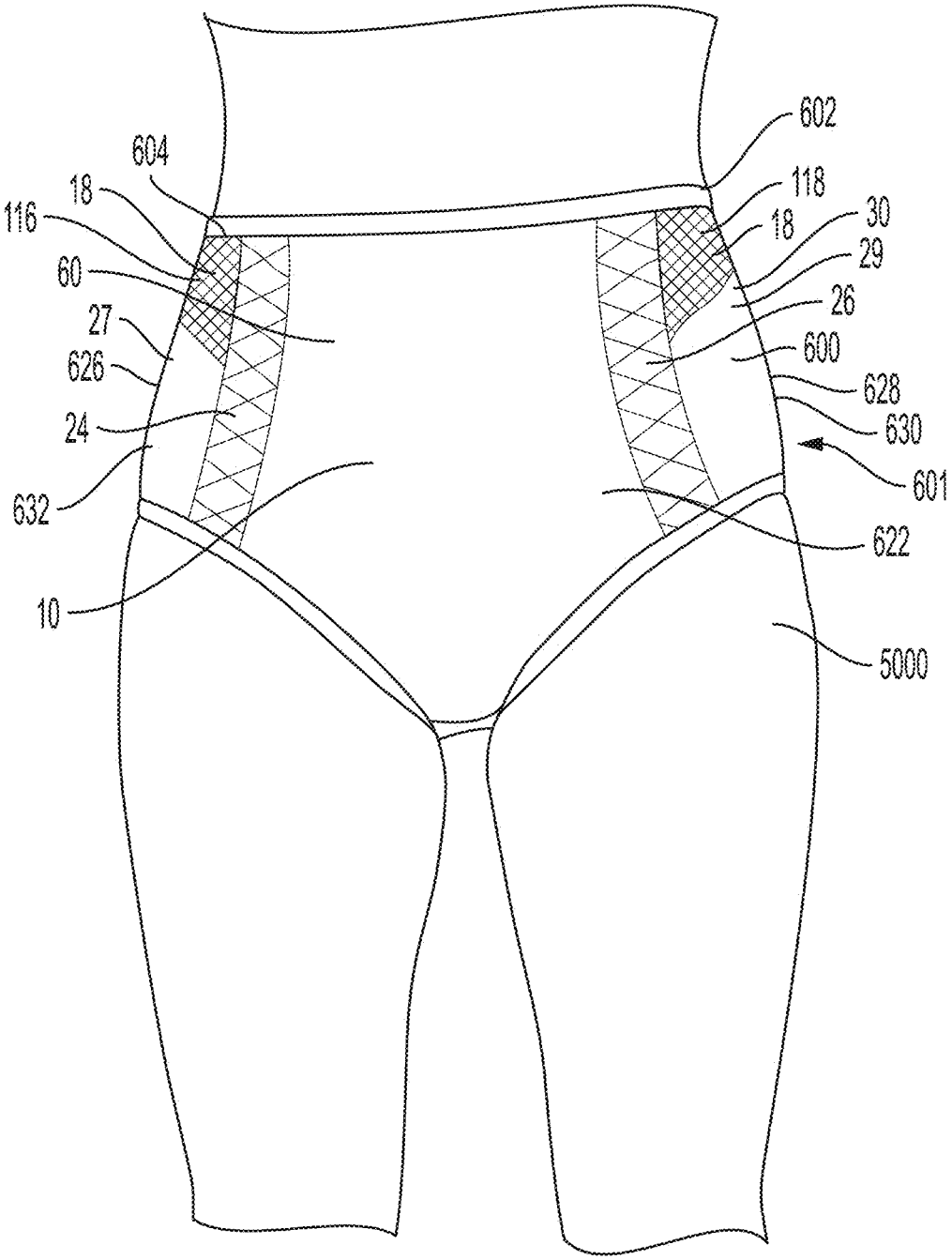
FIG. 6 is a front view of a second embodiment of the liner of FIG. 1 omitting a waist transition region, with the second embodiment of the liner shown in an assembled configuration connected to an outer shell forming a brief, and the brief is inside-out on a wearer's body to show the interior thereof.
Figure 7:
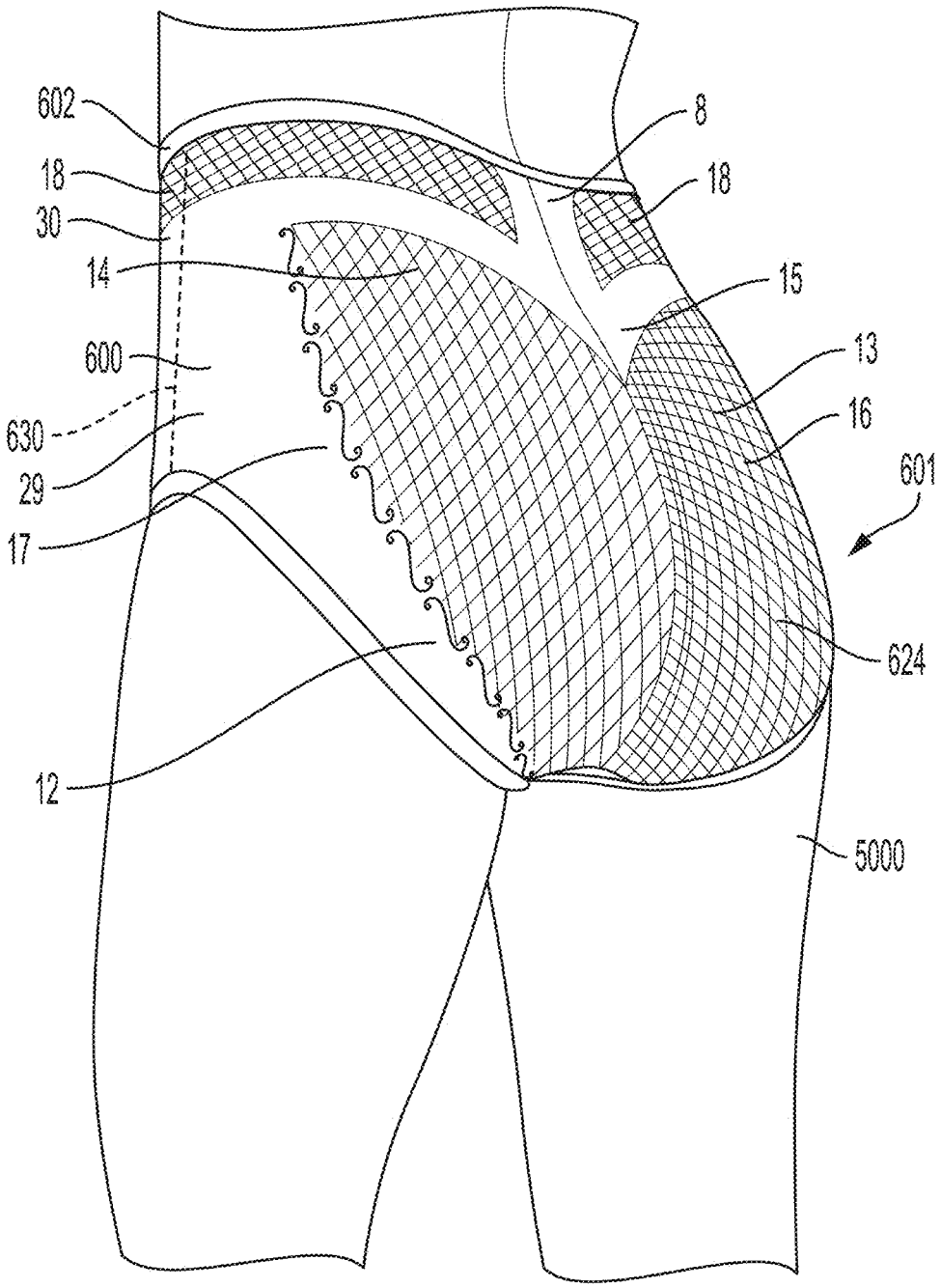
FIG. 7 is a rear perspective view of the brief of FIG. 6, the brief being inside-out on the wearer's body to show the interior thereof.

Referring to FIGS. 6 and 7, an alternative embodiment of liner 100 referred to as liner 600 is shown in an assembled configuration connected to an outer shell 602 to form a brief 601 shown on a wearer's body. Brief 601 can be considered a basic or mid-waist brief. Brief 601 is shown in FIGS. 6 and 7 as inside-out relative to FIG. 8 to show the interior of liner 600. Liner 600 is the same as liner 100, except that liner 600 does not have waist transition region 22 and also covers less of abdomen portion area 60 so that only a middle abdomen and lower abdomen portions are covered. Likewise, outer layer 602 of brief 601 also covers less of abdomen portion area 60. Liner 600 has a top edge 604 above abdominal region 10, first abdominal border region 24 and second abdominal border region 26, waist whittler region 18 and top buttocks surrounding region 15, and super waist whittler region 8. Top edge 604 connects to outer shell 602 by a seam.

In particular, as shown in Table 5a for brief 601 that is a mid-waist brief, side buttocks surrounding region 17 has a modulus @ 30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @ 30% in the width direction around the body that is equal to or greater than 62% more than buttocks region 13. Waist whittler region 18 has a modulus @ 30% in the width direction around the body that is equal to or greater than 7.5% more than buttocks region 13. Super waist whittler region 8 has a modulus @ 30% in the length direction on the body that is equal to or greater than 63% more than buttocks region 13 and the width direction around the body that is equal to or greater than 109% more than buttocks region 13. Abdominal region 10 has a modulus @ 30% in the length direction on the body that is equal to or greater than 108% more than buttocks region 13 and the width direction around the body that is equal to or greater than 100% more than buttocks region 13. First abdominal border region 24 and second abdominal border region 26 have a modulus @ 30% in the length direction on the body that is equal to or greater than 39% more than buttocks region 13.

Further, side buttocks surrounding region 17 has a modulus @ 30% in the length direction on the body that is greater than 65% more than abdominal region 10. First side hip region 27 and second side hip region 29 have a modulus @ 30% in the length direction on the body that is equal to or greater than 87% more than abdominal region 10 and a modulus @ 30% in the width direction around the body that is equal to or greater than 19% lower than abdominal region 10. Waist whittler region 18 has a modulus @ 30% in the width direction around the body that is equal to or greater than 46% lower than abdominal region 10. Super waist whittler region 8 has a modulus @ 30% in the length direction on the body that is equal to or greater than 21% less than abdominal region 10 and the width direction around the body that is equal to or greater than 4.7% more than abdominal region 10. Buttocks region 13 has a modulus @ 30% in the length direction on the body that is equal to or greater than 52% less than abdominal region 10 and the width direction around the body that is equal to or greater than 100% less than abdominal region 10. First abdominal border region 24 and second abdominal border region 26 have a modulus @ 30% in the length direction on the body that is equal to or greater than 33% less than abdominal region 10.

TABLE 5a

FIGS. 6 and 7-MID-WAIST BRIEF

| REGION | L ON BODY-modulus @ 30% | W ON BODY-modulus @ 30% | 45° ANGLE-modulus @ 30% | 15° ANGLE-modulus @ 30% | % higher than Buttocks region 13 for L ON BODY-modulus @ 30% | % higher than Buttocks region 13 for W ON BODY-modulus @ 30% | % lower (−) or % higher (+) than Abdominal region 10 for L ON BODY-modulus @ 30% | % lower (−) or % higher (+) than Abdominal region 10 for W ON BODY-modulus @ 30% |
|---|---|---|---|---|---|---|---|---|
| Buttocks region 13 | 0.41 | 0.53 | | | | | −52% | −100% |

TABLE 5a-continued

FIGS. 6 and 7-MID-WAIST BRIEF

| REGION | L ON BODY-modulus @ 30% | W ON BODY-modulus @ 30% | 45° ANGLE-modulus @ 30% | 15° ANGLE-modulus @ 30% | % higher than Buttocks region 13 for L ON BODY-modulus @ 30% | % higher than Buttocks region 13 for W ON BODY-modulus @ 30% | % lower (−) or % higher (+) than Abdominal region 10 for L ON BODY-modulus @ 30% | % lower (−) or % higher (+) than Abdominal region 10 for W ON BODY-modulus @ 30% |
|---|---|---|---|---|---|---|---|---|
| Bottom Buttocks surrounding region 12 | | | 1.69 | | | | | |
| Side Buttocks surrounding region 17 | 1.41 | | | | 244% | | +65% | |
| First Side Hip region 27, Second Side Hip region 29 | 1.6 | 0.86 | | | 290% | 62% | +87% | −19% |
| Waist Whittler 18 | | 0.57 | | | | 7.5% | | −46% |
| Top Buttocks surrounding region 15 | | | 0.38 | 0.72 | | | | |
| Super Waist Whittler 8 | 0.67 | 1.11 | | | 63% | 109% | −21% | +4.7% |
| Abdominal region 10 | 0.855 | 1.06 | | | 108% | 100% | | |
| First Abdominal border region 24, Second Abdominal border region 26 | 0.57 | | | | 39% | | −33% | |

As a modification of this embodiment, brief 601 only has a front portion 622 of liner 600. In this modification of liner 600, front portion 622 is connected to outer shell 602 by two side seams on opposite sides 626, 628 of front portion 622. Further, rear portion 624 of liner 600 shown in FIG. 7 is not included in this modification of liner 600. As shown in Table 5b below for brief 601 that is the mid-waist brief, abdominal region 10 has a modulus @ 30% in the width direction around the body that is equal to or greater than 19% higher than first side hip region 27 and second side hip region 29 and equal to or greater than 46% higher than waist whittler region 18.

TABLE 5b

FIG. 6-MID-WAIST BRIEF FRONT

| REGION | W ON BODY-modulus @ 30% | % lower than Abdominal region 10 for W ON BODY-modulus @ 30% |
|---|---|---|
| Abdominal region 10 | 1.06 | |
| First Abdominal border region 24, Second Abdominal border region 26 | | |
| First Side Hip region 27, Second Side Hip region 29 | 0.86 | 19% |
| Waist Whittler region 18 | 0.57 | 46% |

In this modification of liner 600, front portion 622 provides the functionality of the regions, as discussed for liner 100, namely, abdominal region 10, first abdominal border region 24 and second abdominal border region 26. Front portion 622 also provides partial functionality of regions that are partially present, namely, waist whittler region 18, first side hip region 27 and second side hip region 29. A portion of first side hip region 27 and second side hip region 29 that are in front portion 622 stretch over portions of hip areas 30 offering reshaping and support to minimize or flatten this area. A portion of waist whittler region 18 in front portion 622 stretches over a portion of the wearers body 5000 above hip area 30 around the waistline of the wearer's body 5000 to offer reshaping, control and support. Along with abdominal region 10, first abdominal border region 24 and second abdominal border region 26, the portion of waist whittler region 18 increases the ability to flatter, re-sculpt, streamline, reshape and smooth a wearer's body because they minimize, reshape and re-sculpt for more desirable torso curves.

In yet another modification or embodiment, brief 601 has only rear portion 624 of liner 600. In this modification of liner 600, rear portion 624 is connected to outer shell 602 by two side seams 630, 632 on opposite sides 626, 628 (as shown in FIG. 6) of rear portion 624. Front portion 622 of liner 600 shown in FIG. 6 is not included in this modification of liner 600. In this modification, rear portion 624 has the same functionality of its regions as discussed for liner 100, namely, buttocks region 13, super waist whittler region 8, top buttocks surrounding region 15, side buttocks surrounding region 17 and bottom buttocks surrounding region 12. However, the other regions are altered in that rear portion 624 provides partial functionality of regions since they are partially present, namely, waist whittler region 18, first side hip region 27 and second side hip region 29. Also, only the portion of first side hip region 27 and second side hip region 29 that are in rear portion 624 stretch over portions of hip areas 30 offering reshaping and support to minimize or flatten this area. Further, only a portion of waist whittler region 18 in rear portion 624 stretches over a portion of the wearers body 5000 above hip area 30 around the waistline of the wearer's body 5000 to offer reshaping, control and support. The portion of waist whittler region 18 increases the ability to flatter, re-sculpt, streamline, reshape and smooth a wearer's body because it minimizes, reshapes and re-sculpts for more desirable torso curves. As shown in Table 6 below, buttocks region 13 has the lowest modulus @ 30% in the length direction on the body and width direction around the body of those regions that were measured. In particular, side buttocks surrounding region 17 has a modulus @ 30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @ 30% in the width direction around the body that is equal to or greater than 62% more than buttocks region 13. Waist whittler region 18 has a modulus @ 30% in the width direction around the body that is equal to or greater than 7.5% more than buttocks region 13.

up from rear horizontal seam 136, shown in FIG. 1. A clean finish seam is formed in top edge 604, shown in FIG. 6, with rubber in the clean finish seam and with right sides of liner 600 and outer shell 602 together. Legs 2104, 2106 that include first leg hole portion 123 and second leg hole portion 125, respectively, of liner 600 and corresponding leg hole portions of outer shell 602 are clean finished with rubber with right sides of liner 600 and outer shell 602 together. A fold line is formed at the location of axis A shown in FIG. 1 in liner 600 so that first side edge portion 112 overlaps second side edge portion 114 with right sides together and placed down on a sewing machine. Outer shell 602 is similarly sized and shaped as liner 600. Outer shell 602 is similarly folded as liner 600 so that a first side edge portion 112 overlaps a second side edge portion 114 right sides together. Outer shell 602 that has been folded is placed down on liner 600 that has been folded so that four ply of fabric are on top of one another. The four plies of fabric are sewn forming a center back seam that also forms single vertical center back seam 132 of liner 600, first bottom side edge portion 122 and second bottom side edge portion 124 are joined to rear horizontal seam 136 leaving a 2 inch opening to turn. The reversible garment is turned through the 2 inch opening and a single needle stitch closes the 2 inch opening.

High waist brief 202 can be constructed as a reversible garment similar to brief 601.

Figure 11:
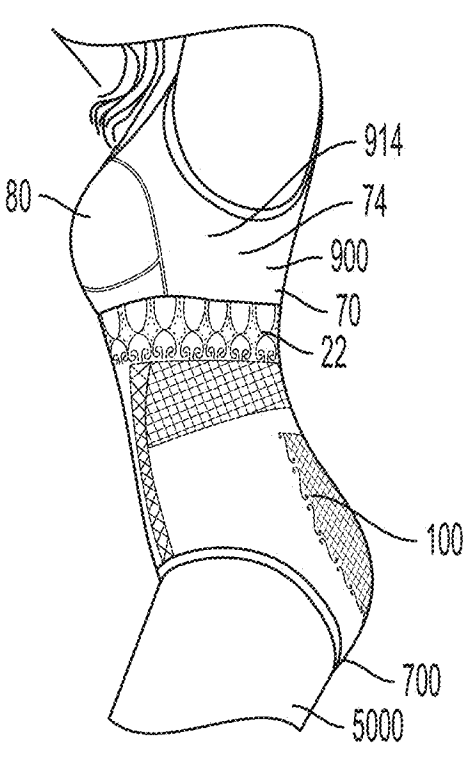
FIG. 11 is a side view of the swimsuit of FIG. 9, the swimsuit being inside-out on the wearer's body to show the interior thereof.
Figure 10:
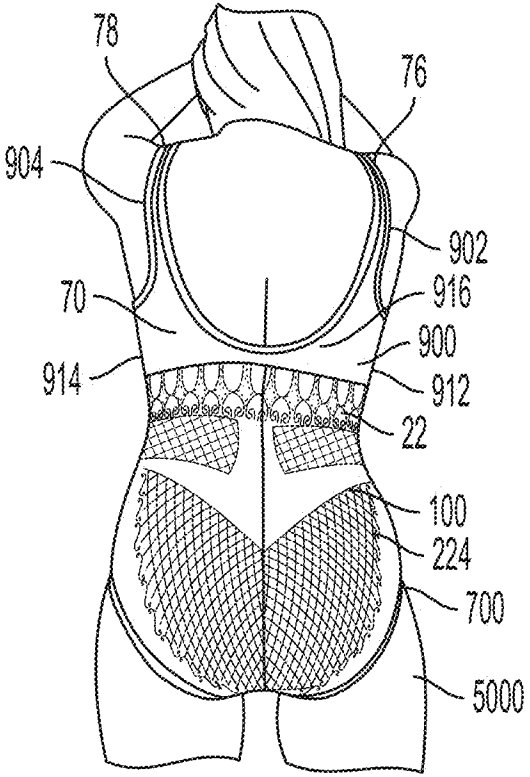
FIG. 10 is a rear view of the swimsuit of FIG. 9, the swimsuit being inside-out on the wearer's body to show the interior thereof.
Figure 9:
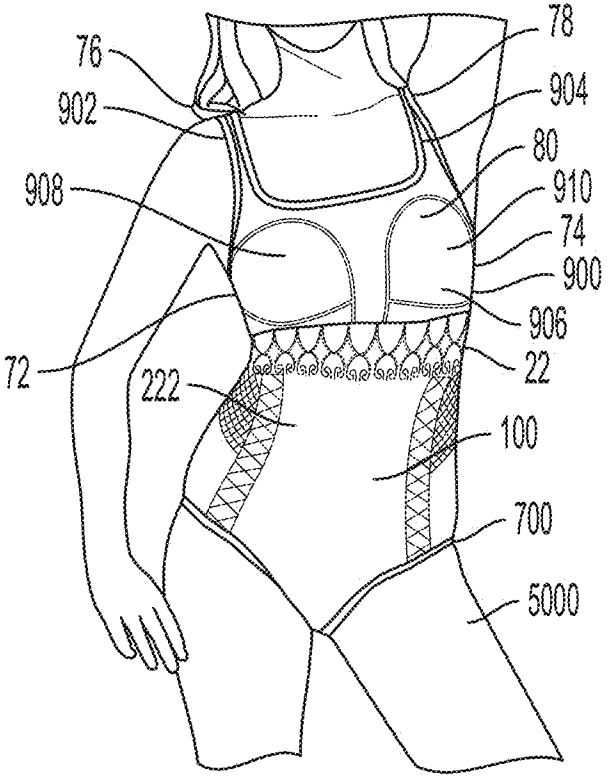
FIG. 9 is a front view of the liner of FIG. 1 in an assembled configuration connected to an outer shell forming a swimsuit, the swimsuit being inside-out on a wearer's body to show the interior thereof.

Referring to the embodiments in FIGS. 9-11, liner 100 is connected to a bra portion 900 by a seam. Liner 100 when connected to bra portion 900 can form an undergarment, swim suit, top, dress, or other garment having a bra portion. Liner 100 when connected to bra portion 900 can have a continuous or spliced outer shell layer 700 that covers both liner 100 and bra portion 900. Liner 100 when connected to

TABLE 6

FIG. 7- ID-WAIST BRIEF REAR

| REGION | L ON BODY-modulus @ 30% | W ON BODY-modulus @ 30% | 45° ANGLE-modulus @ 30% | % lower than Buttocks region 13 for L ON BODY-modulus @ 30% | % lower than Buttocks region 13 for W ON BODY-modulus @ 30% |
|---|---|---|---|---|---|
| Buttocks region 13 | 0.41 | 0.53 | | | |
| Side Buttocks surrounding region 17 | 1.41 | | | 244% | |
| Bottom Buttocks surrounding region 12 | | | 1.69 | | |
| First Side Hip region 27, Second Side Hip region 29 | 1.6 | 0.86 | | 290% | 62% |
| Waist Whittler 18 | | 0.57 | | | 7.5% |
| Top Buttocks surrounding region 15 | | | 0.38 | | |

Figure 8:
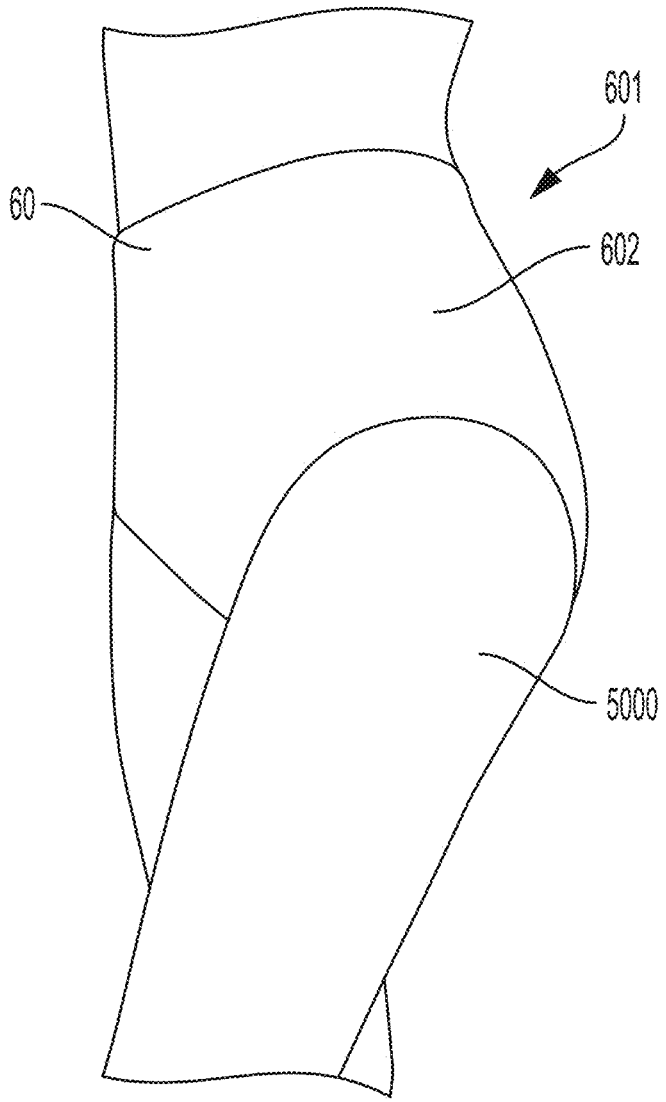
FIG. 8 is a front perspective view of the brief of FIG. 6, the brief being on the wearer's body to show the exterior thereof.

Referring to FIG. 8, outer shell 602 covers interior liner 600 shown in FIGS. 6 and 7 when on the body of wearer 5000.

Referring to FIGS. 1, 6 and 21-23, brief 601 can be modified to be a reversible garment. Liner 600 and outer shell 602 are connected so that when outer shell 602 is exterior to the wearer's body, outer shell 602 covers liner 600 and when liner 600 is exterior to the wearer's body, liner 600 covers outer shell 602. To construct the reversible garment, crotch piece 135 is joined to liner 600 by front horizontal seam 134 and rear horizontal seam 136, both shown in FIG. 1, with flatlock stitching. Vertical center back seam 132 of liner 600 joins together first side edge portion 112 and second side edge portion 114, both shown in FIG. 1, two (2) inches down from a waist seam 2102 and 2 inches bra portion 900 has outer shell layer 700 that covers the entirety of liner 100 and bra portion 900 if inverted from FIG. 9. Bra portion 900 covers a breast area 80, a back area 70, shown in FIG. 10, side areas 72, 74, and shoulder areas 76, 78 of the body of wearer 5000. As shown, bra portion 900 has shoulder straps 902, 904 that supports bra portion 900 on shoulder areas 76, 78 of the body of wearer 5000. Bra portion 900 has a breast portion 906 with cups 908, 910, or other breast support, that support breasts of the body of wearer 5000. Bra portion 900 has side portions 912, 914 also shown in FIG. 11 and back portion 916 that supports bra portion 900 on the body of wearer 5000. If liner 100 is connected to a bra top or bust support, waist transition region 22 provides a transition to the bra top or bust support. Alternatively, for liner 100 connected to bra portion 900 has continuous or spliced outer shell layer 700 that can have only front portion 222 or rear portion 224 of liner 100. Liner 100 when connected to bra portion 900 can be any strap silhouette including but not limited to: built ups, halter, bandeau, cross back binding, multiple binding straps, elastic, and the like.

Figure 12A:
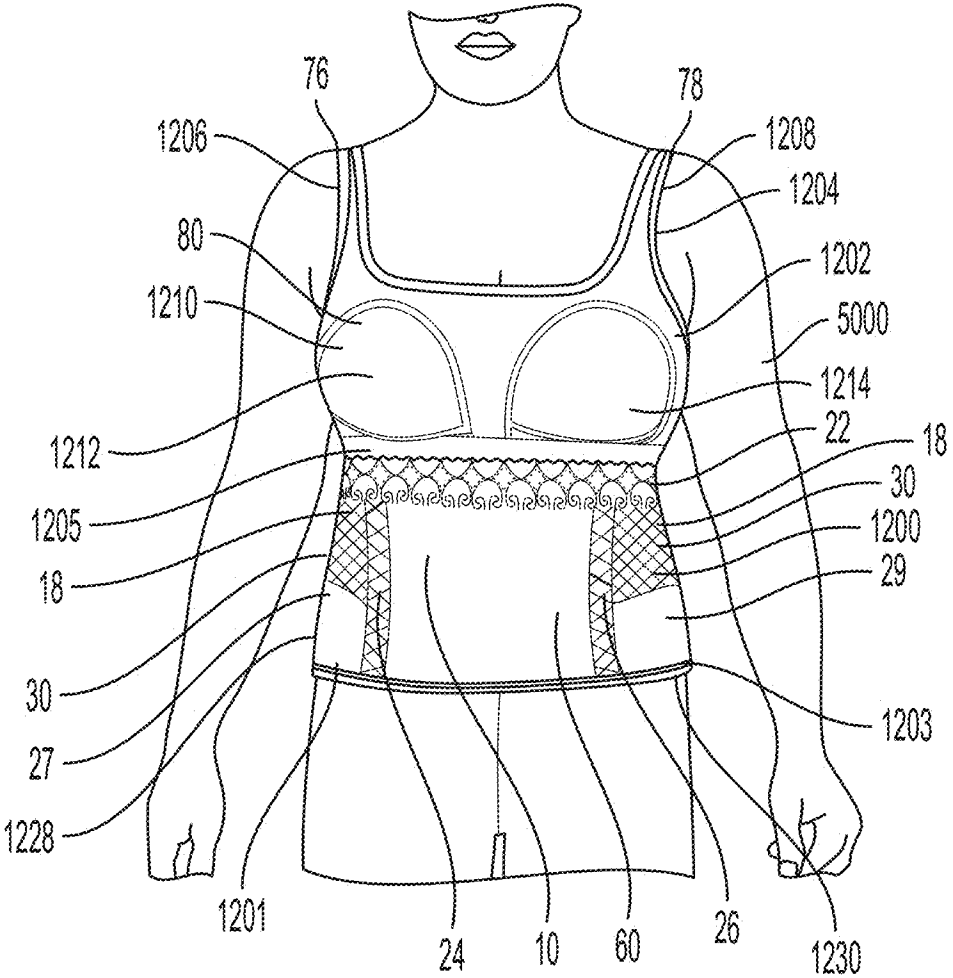
FIG. 12A is a front view of a third embodiment of the liner of FIG. 1 omitting a bottom portion, with the third embodiment liner shown in an assembled configuration connected to an outer shell forming a tankini, and the tankini being inside-out on the wearer's body to show the interior thereof.
Figure 12B:
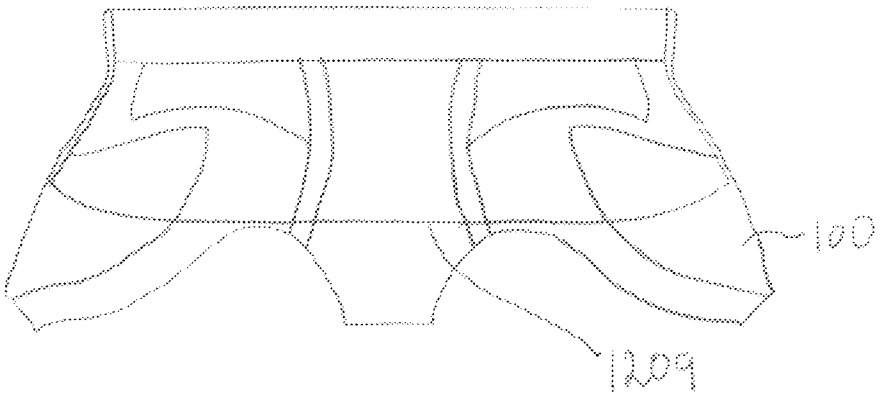
FIG. 12B is a schematic drawing of the third embodiment of the liner superimposed over the first embodiment of the liner.

Referring to FIG. 12A, an alternative embodiment of liner 100 is referred to as liner 1200. Liner 1200 is the same as liner 100, except liner 1200 forms a bottom edge 1201, and does not have a portion of liner 100 from leg holes 141, 143 to crotch piece 135, as shown in FIGS. 2 and 3. The portion of liner 100 that is included in liner 1200 is shown by line 1209 in FIG. 12B. Bottom edge 1201 can have a band 1203 or be a hem or attach to a bottom of a shell. Band 1203 can be elastic and can have a layer of silicone or similar adhesive type material or application that will face the body to help maintain the position of bottom edge 1201 on the body.

Figure 13:
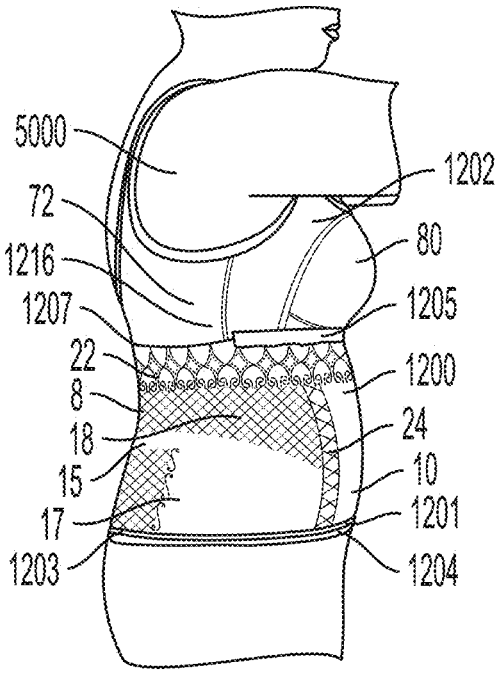
FIG. 13 is a side view of the tankini of FIG. 12A, the tankini being inside-out on the wearer's body to show the interior thereof.
Figure 14:
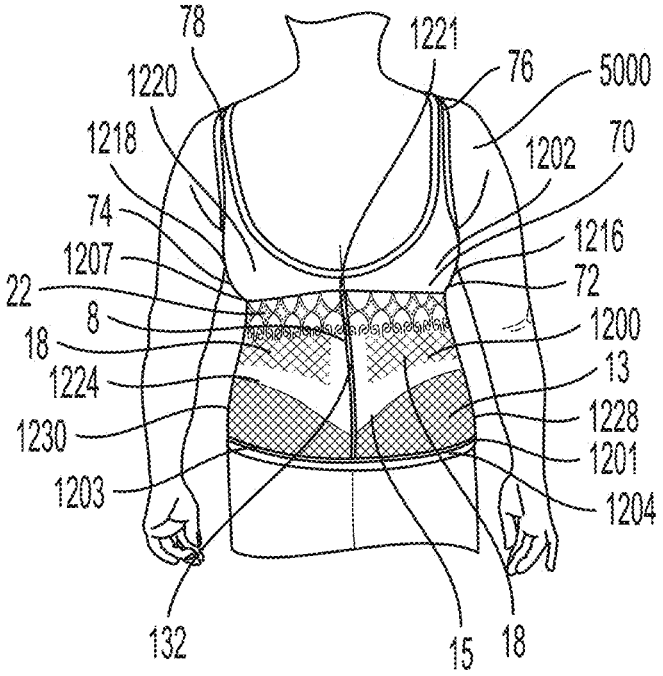
FIG. 14 is a rear view of the tankini of FIG. 12A, the tankini being inside-out on the wearer's body to show the interior thereof.
Figure 15:
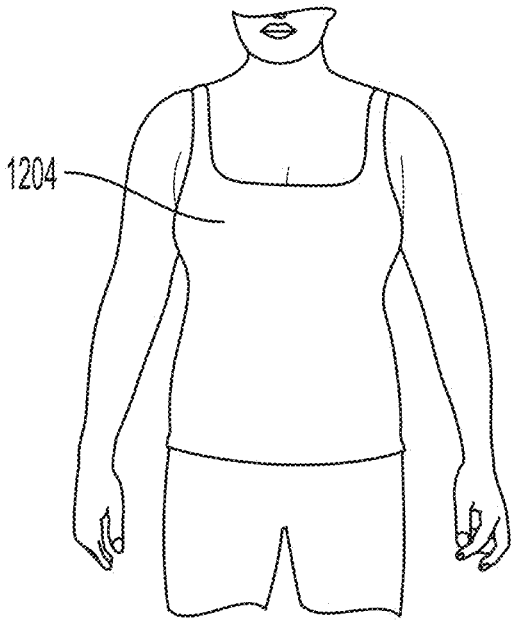
FIG. 15 is a front view of the tankini of FIG. 12A, the tankini being on a wearer's body to show the exterior thereof.

Liner 1200 is connected to a bra portion 1202. Liner 1200 with connected bra portion 1202 can form an undergarment, swimsuit tankini top, tank top tunic or other top, or a dress. Liner 1200 with connected bra portion 1202 can have a continuous or spliced outer shell layer 1204 that covers both liner 1200 and bra portion 1202. Liner 1200 with connected bra portion 1202 of FIGS. 12-14 has outer shell 1204 that covers the entirety of liner 1200 and bra portion 1202 as shown in FIG. 15. Liner 1200 is connected to bra portion 1202 at waist transition region 22 by a seam 1207 shown in FIGS. 13 and 14. As shown in FIG. 12A, bottom edge 1201 can be attached to outer shell 1204, e.g., by a seam. Alternatively, bottom edge 1201 can be free and not connected to outer shell 1204.

Referring again to FIG. 12A, bra portion 1202 covers a breast area 80, a back area 70 (shown in FIG. 14), side areas 72, 74, and shoulder areas 76, 78 of the body of wearer 5000. Bra portion 1202 has shoulder straps 1206, 1208 that supports bra portion 1202 on shoulder areas 76, 78 of the body of wearer 5000. Bra portion 1202 has a breast portion 1210 with cups 1212, 1214, or other breast support, that support breasts of the body of wearer 5000. Bra portion 1202 has side portions 1216, 1218 and back portion 1220 (shown in FIG. 14) that supports bra portion 1202 on the body of wearer 5000. Bra portion 1202 has a band 1205 that extends from breast portion 1210 to overlap a portion of waist transition region 22. Band 1205 is connected to breast portion 1210 by a seam. Band 1205 terminates or finishes on opposite sides or at imaginary side seams at back portion 1220. Liner 1200 is connected to bra portion 1202 at waist transition region 22 by seam 1207, shown in FIGS. 13 and 14, that is covered by band 1205 in front of the garment. Vertical center back seam 132 of liner 1200 can be made continuous with a back seam 1221, and can be active merrow stitching for instance, shown in FIG. 14, in back portion 1220 of bra portion 1202. As alternative sewing detail band 1205 can also be continuous around bottom breast portion 1210 and bottom back portion 1220 at seam 1207 attaching liner 1200 at waist transition region 22.

Liner 1200 provides the same functionality of the region present, namely, waist whittler 18, super waist whittler 8 and waist transition region 22, as described above for that region in the discussion of liner 100.

In comparison to liner 100, liner 1200 also provides full functionality of all regions fully present and provides slightly lessened functionality of other portions of regions partially present. Functioning regions that are present, namely abdominal region 10, waist transition region 22, first abdominal boarder region 24 and second abdominal boarder region 26, first side hip region 27 and second side hip region 29, and top buttocks surrounding region 15. There is slightly lessened functionality of other regions partially present, such as buttocks region 13 (FIGS. 13 & 14) and side buttocks surrounding region 17, now function to extend first side hip region 27 and second side hip region 29. Further, the portion of abdominal region 10 that is included in liner 1200 stretches over a portion of abdomen area 60 of the wearer's body 5000 to offer shaping and support. That portion of abdominal region 10, and the portions of first abdominal border region 24 and second abdominal border region 26 included in liner 1200, increase the flattering of a wearer's body because they minimize, re-sculpt, streamline, reshape and smooth for more desirable torso curves. The portions of first abdominal border region 24 and second abdominal border region 26 separates the portion of abdominal region 10 from portions of first side hip region 27 and second side hip region 29 included in liner 1200 for comfort while the wearer 5000 is wearing liner 1200 as well as when the wearer 5000 takes liner 1200 on and off. The portions of first side hip region 27 and second side hip region 29 included in liner 1200 stretch over hip area 30 offering reshaping and support. The portions of first side hip region 27 and second side hip region 29 shape hip area 30 to minimize or flatten this area. The portions of first side hip region 27 and second side hip region 29 can be free of seams and create the ability to sculpt and shape the wearer's body and eliminates the side seam thickness, bulge and visibility. The complete portion of waist whittler region 18 included in liner 1200 stretches over an area above hip area 30 around the waistline of the wearer's body 5000 to offer reshaping, control and support. Along with the portion of abdominal region 10, the portions of first abdominal border region 24 and second abdominal border region 26, the portion of waist whittler region 18 flatters because they minimize, re-sculpt, streamline, reshape and smooth the natural and for more desirable torso curves.

Although the butt lift cannot be activated on the body due to the absence of bottom buttocks surrounding region 12, a portion of side buttocks surrounding region 17 and buttocks region 13 in liner 1200, the portion of buttocks region 13 in liner 1200 provides ventilation and aeration to the body of the wearer 5000 for cooling comfort and reducing sweat. Top buttocks surrounding region 15 helps to extend and enhance both the "action" of waist whittler region 18 and super waist whittler region 8. In addition, the portion of side buttocks surrounding region 17 in liner 1200 smooths and reshapes the portions of the body of the wearer 5000 that are covered by portion of side buttocks surrounding region 17, for example, in combination with first side hip region 27 and second side hip region 29, the side hips or body protrusions of the wearer are reshaped and smoothed to reduce an appearance of bumps referred to as "love handles". As shown in Table 7 below for liner 1200 that can be a tankini, abdominal region 10 and super waist whittler region 8 have the highest modulus in the width direction around the body to offer shaping and support. Moreover, abdominal region 10 has a modulus in the length direction on the body that is higher than some of the other regions to offer further shaping and support.

In particular in this embodiment, side buttocks surrounding region 17 has a modulus @ 30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @ 30% in the width direction around the body that is equal to or greater than 62% more than buttocks region 13. Waist whittler region 18 has a modulus @ 30% in the width direction around the body that is equal to or greater than 7.5% more than buttocks region 13. Waist transition region 22 has a modulus @30% in the width direction around the body that is equal to or greater than 36% more than buttocks region 13. Super waist whittler region 8 has a modulus @30% in the length direction on the body that is equal to or greater than 63% more than buttocks region 13 and the width direction around the body that is equal to or greater than 109% more than buttocks region 13. Abdominal region 10 has a modulus @ 30% in the length direction on the body that is equal to or greater than 108% more than buttocks region 13 and the width direction around the body that is equal to or greater than 100% more than buttocks region 13. First abdominal border region 24 and second abdominal border region 26 have a modulus @ 30% in the length direction on the body that is equal to or greater than 39% more than buttocks region 13.

In addition, side buttocks surrounding region 17 has a modulus @30% in the length direction on the body that is greater than 65% more than abdominal region 10. First side hip region 27 and second side hip region 29 have a modulus @ 30% in the length direction on the body that is equal to or greater than 87% more than abdominal region 10 and a modulus @ 30% in the width direction around the body that is equal to or greater than 19% lower than abdominal region 10. Waist whittler region 18 has a modulus @ 30% in the width direction around the body that is equal to or greater than 46% lower than abdominal region 10. Waist transition region 22 has a modulus @ 30% in the width direction around the body that is equal to or greater than 32% lower than abdominal region 10. Super waist whittler region 8 has a modulus @ 30% in the length direction on the body that is equal to or greater than 21% less than abdominal region 10 and the width direction around the body that is equal to or greater than 4.7% more than abdominal region 10. Buttocks region 13 has a modulus @ 30% in the length direction on the body that is equal to or greater than 52% less than abdominal region 10 and the width direction around the body that is equal to or greater than 100% less than abdominal region 10. First abdominal border region 24 and second abdominal border region 26 have a modulus @ 30% in the length direction on the body that is equal to or greater than 33% less than abdominal region 10.

TABLE 7

FIG. 12A-TANKINI

| REGION | L ON BODY-modulus @ 30% | W ON BODY-modulus @ 30% | 45° ANGLE-modulus @ 30% | % lower than Buttocks region 13 for L ON BODY-modulus @ 30% | % lower than Buttocks region 13 for W ON BODY-modulus @ 30% | % lower (−) or % higher (+) than Abdominal region 10 for L ON BODY-modulus @ 30% | % lower (−) or % higher (+) than Abdominal region 10 for W ON BODY-modulus @ 30% |
|---|---|---|---|---|---|---|---|
| Abdominal region 10 | 0.85 | 1.06 | | 108% | 100% | | |
| First Abdominal border region 24, Second Abdominal border region 26 | 0.57 | | | 39% | | −33% | |
| First Side Hip region 27, Second Side Hip region 29 | 1.6 | 0.86 | | 290% | 62% | +87% | −19% |
| Waist Transition region 22 | | 0.72 | | | 36% | | −32% |
| Waist Whittler 18 | | 0.57 | | | 7.5% | | −46% |
| Super Waist Whittler 8 | 0.67 | 1.11 | | 63% | 109% | −21% | +4.7% |
| Top Buttocks surrounding region 15 | | | 0.38 | | | | |
| Buttocks region 13 | 0.41 | 0.53 | | | | −52% | −100% |
| Side buttocks surrounding region 17 | 1.41 | | | 244% | | +65% | |

Figure 16:
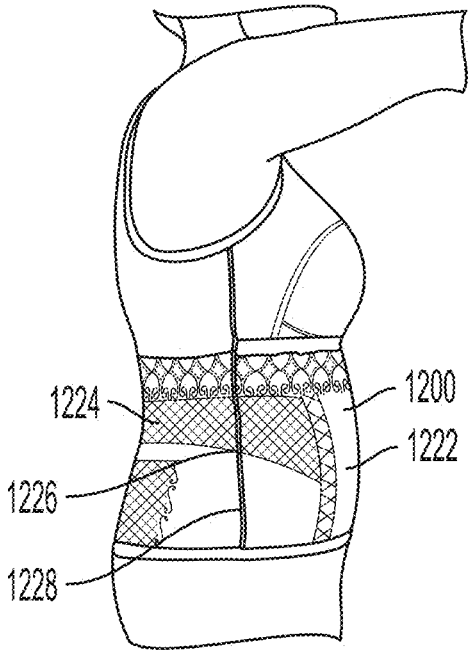
FIG. 16 is a side view of the third embodiment of the liner of FIG. 12A that is modified to have side seams, with the modified third embodiment of the liner shown in an assembled configuration connected to an outer shell forming a tankini, and the tankini having the modified third embodiment of the liner that is inside-out on the wearer's body to show the interior thereof.
Figures 21, 22, 23:
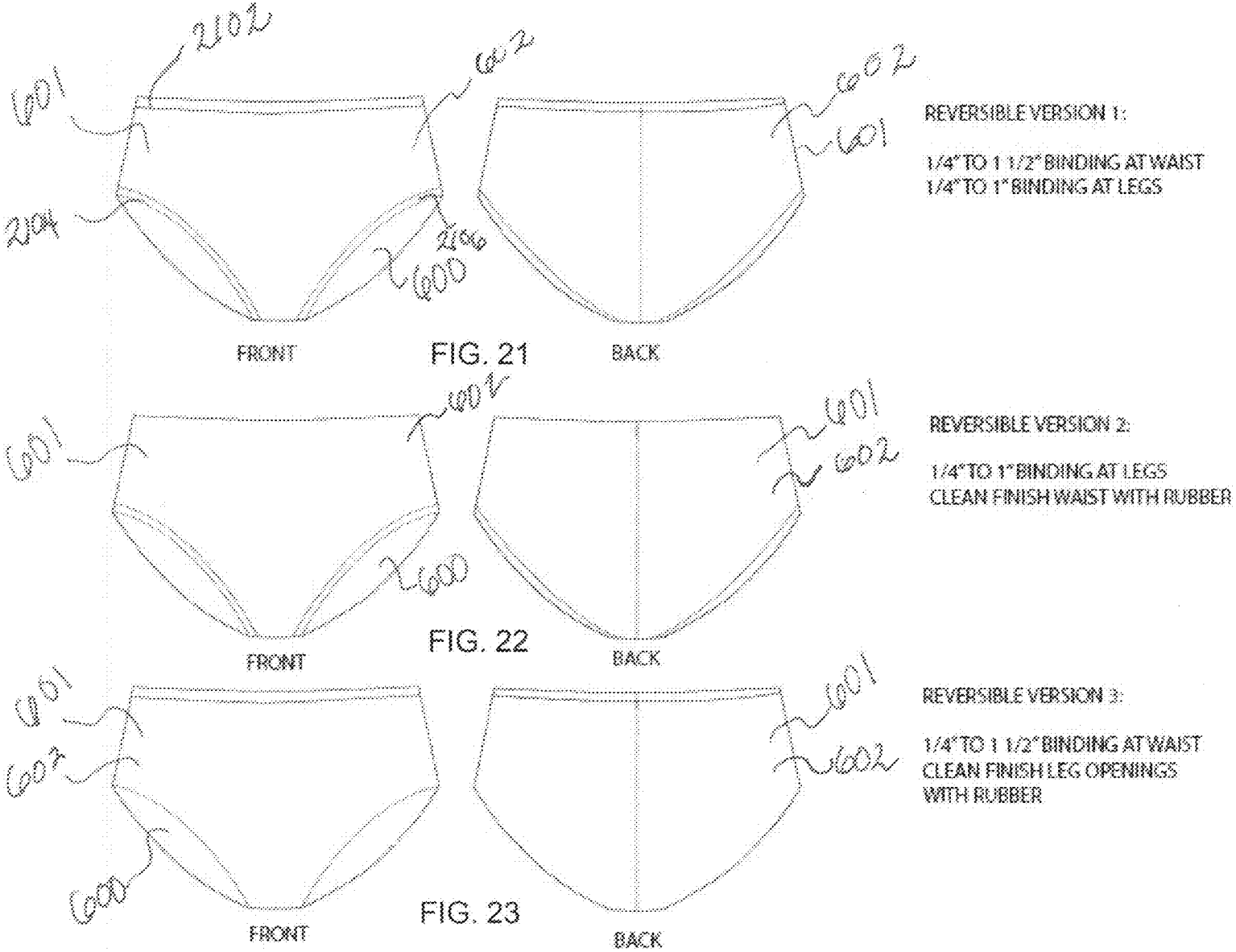
FIG. 21 is a schematic drawing of the second embodiment of the liner that is reversible that has ¼ inch to 1½ inch binding at a waist portion and ¼ inch to 1 inch binding at the legs.
FIG. 22 is a schematic drawing of the second embodiment of the liner that is reversible that has ¼ inch to 1 inch binding at the legs and a clean finish waist with rubber.
FIG. 23 is a schematic drawing of the second embodiment of the liner that is reversible that has ¼ inch to 1½ inch binding at a waist portion and clean finish leg openings with rubber.

Referring to FIG. 16, alternatively, liner 1200 could form a front portion 1222 that is separate from a rear portion 1224. Front portion 1222 and rear portion 1224 can be connected to each other by two side seams 1226 each on sides 1228, 1230 as shown in FIG. 12A.

Another alternative, modification or embodiment to liner 1200 has a swim top that is only front portion 1222 of liner 1200. In this modification of liner 1200, front portion 1222 is connected to outer shell 1204 by two side seams 1226 on opposite sides 1228, 1230, shown in FIG. 12A, of front portion 1222. A rear portion 1224 of liner 1200 shown in FIG. 16 is not included in this modification of liner 1200, but a different rear portion of another lining fabric could or could not be optional.

In this modification of liner 1200, front portion 1222 provides the functionality of regions discussed for the above embodiment of liner 1200, that are present in this modification, namely, abdominal region 10, first abdominal border region 24 and second abdominal border region 26, waist whittler region 18, first side hip region 27 and second side hip region 29, and waist transition region 22. The portions of first side hip region 27 and second side hip region 29 in front portion 1222 stretch over a portion of hip area 30 offering shaping and support to minimize or flatten this area. The portion of waist whittler region 18 in front portion 1222 stretches over a portion of the wearers body 5000 above hip area 30 around the waistline of the wearer's body 5000 to offer reshaping, control and support. Along with the portion of abdominal region 10, the portions of first abdominal border region 24 and second abdominal border region 26, the portion of waist whittler region 18 flatter, a wearer's body because they minimize, re-sculpt, streamline, reshape and smooth for more desirable torso curves. The portion of waist transition region 22 in front portion 1222, along with the portion of abdominal region 10, the portions of first abdominal border region 24 and second abdominal border region 26 and the portion of waist whittler region 18, increase the ability to flatter because they minimize, re-sculpt, streamline, reshape and smooth for more desirable torso curves. Accordingly, these same portions of regions, extending up to an underbust 66 of the wearer eliminates or minimizes a bulge referred to as a "muffin top" where it covers the wearer 5000 and smooths out lumps and bumps all the way up in to a high waist. The portion of waist transition region 22 minimizes visibility of different power constructions of the regions present while smoothing any seams and curves of a wearer's body and providing overall comfort.

As shown in Table 8 below for liner 1200 that can be a tankini, abdominal region 10 and super waist whittler region 8 have the highest modulus in the width direction around the body to offer shaping and support. In particular, first side hip region 27 and second side hip region 29 have a modulus @ 30% in the length direction on the body that is equal to or greater than 87% more than abdominal region 10 and a modulus @ 30% in the width direction around the body that is equal to or greater than 19% lower than abdominal region 10. Waist whittler region 18 has a modulus @ 30% in the width direction around the body that is equal to or greater than 46% lower than abdominal region 10. Waist transition region 22 has a modulus @ 30% in the width direction around the body that is equal to or greater than 32% lower than abdominal region 10. First abdominal border region 24 and second abdominal border region 26 have a modulus @ 30% in the length direction on the body that is equal to or greater than 33% less than abdominal region 10.

TABLE 8

FIG. 12A-TANKINI FRONT-180°

| REGION | L ON BODY-modulus @ 30% | W ON BODY-modulus @ 30% | % lower (−) or % higher (+) than Abdominal region 10 for L ON BODY-modulus @ 30% | % lower (−) or % higher (+) than Abdominal region 10 for W ON BODY-modulus (a) 30% |
|---|---|---|---|---|
| Abdominal region 10 | 0.85 | 1.06 | | |
| First Abdominal border region 24, Second Abdominal border region 26 | 0.57 | | −33% | |
| First Side Hip region 27, Second Side Hip region 29 | 1.6 | 0.86 | +87% | −19% |
| Waist Transition region 22 | | 0.72 | | −32% |
| Waist Whittler 18 | | 0.57 | | −46% |

Still another alternative modification, or embodiment that the swim tankini top is using only rear portion 1224 of liner 1200. In this modification of liner 1200, rear portion 1224 is connected to outer shell 1204 by two side seams 1226 on opposite sides 1228, 1230. Front portion 1222 of liner 1200 shown in FIG. 16 is not included in this modification of liner 1200, but a different front portion of another lining fabric could or could not be optional.

In this modification of liner 1200, rear portion 1224 provides the functionality of regions that are present, namely, the portion of side buttocks surrounding region 17, top buttocks surrounding region 15, buttocks region 13, waist whittler region 18, super waist whittler 8, first side hip region 27 and second side hip region 29, and waist transition region 22. The portion of side buttocks surrounding region 17, top buttocks surrounding region 15 and buttocks region 13 provide the functionality as discussed above for liner 1200. The portions of first side hip region 27 and second side hip region 29 in rear portion 1224 stretch over a portion of hip area 30 to offer reshaping and support to minimize or flatten this area. The portions of waist whittler region 18 in rear portion 1224 stretch over portions of the wearers body 5000 above hip area 30 around the waistline of the wearer's body 5000 to also offer reshaping, control and support. The portion of waist transition region 22 in rear portion 1224, along with the portion of waist whittler regions 18, shapes and sculpts the natural and desired torso curves. Accordingly, the portion of waist transition region 22 in rear portion 1224 extends up to the high waist of the wearer to eliminate or minimize the bulge referred to as a "muffin top" where it covers the wearer's body 5000 and smooths out lumps and bumps to a high waist. The portion of waist transition region 22 minimizes visibility of different power constructions of the regions present while smoothing any seams and curves of a wearer's body and providing overall comfort.

As shown in Table 9 below for liner 1200 that can be a tankini, buttocks region 13 has the lowest modulus @ 30% in the length direction on the body and width direction around the body of those regions that were measured. In particular, side buttocks surrounding region 17 has a modulus @ 30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @ 30% in the width direction around the body that is equal to or greater than 62% more than buttocks region 13. Waist whittler region 18 has a modulus @ 30% in the width direction around the body that is equal to or greater than 7.5% more than buttocks region 13. Waist transition region 22 has a modulus @ 30% in the width direction around the body that is equal to or greater than 36% more than buttocks region 13. Super waist whittler region 8 has a modulus @ 30% in the length direction on the body that is equal to or greater than 63% more than buttocks region 13 and the width direction around the body that is equal to or greater than 109% more than buttocks region 13.

TABLE 9

FIG. 14-TANKINI REAR

| REGION | L ON BODY-modulus @ 30% | W ON BODY-modulus @ 30% | 45° ANGLE-modulus @ 30% | % lower than Buttocks region 13 for L ON BODY-modulus @ 30% | % lower than Buttocks region 13 for W ON BODY-modulus @ 30% |
|---|---|---|---|---|---|
| Waist Transition region 22 | | 0.72 | | | 36% |
| Super Waist Whittler 8 | 0.67 | 1.11 | | 63% | 109% |
| Waist Whittler 18 | | 0.57 | | | 7.5% |
| Top Buttocks surrounding region 15 | | | 0.38 | | |
| Buttocks region 13 | 0.41 | 0.53 | | | |
| Side buttocks surrounding region 17 | 1.41 | | | 244% | |
| First Side Hip region 27, Second Side Hip region 29 | 1.6 | 0.86 | | 290% | 62% |

Figure 24:
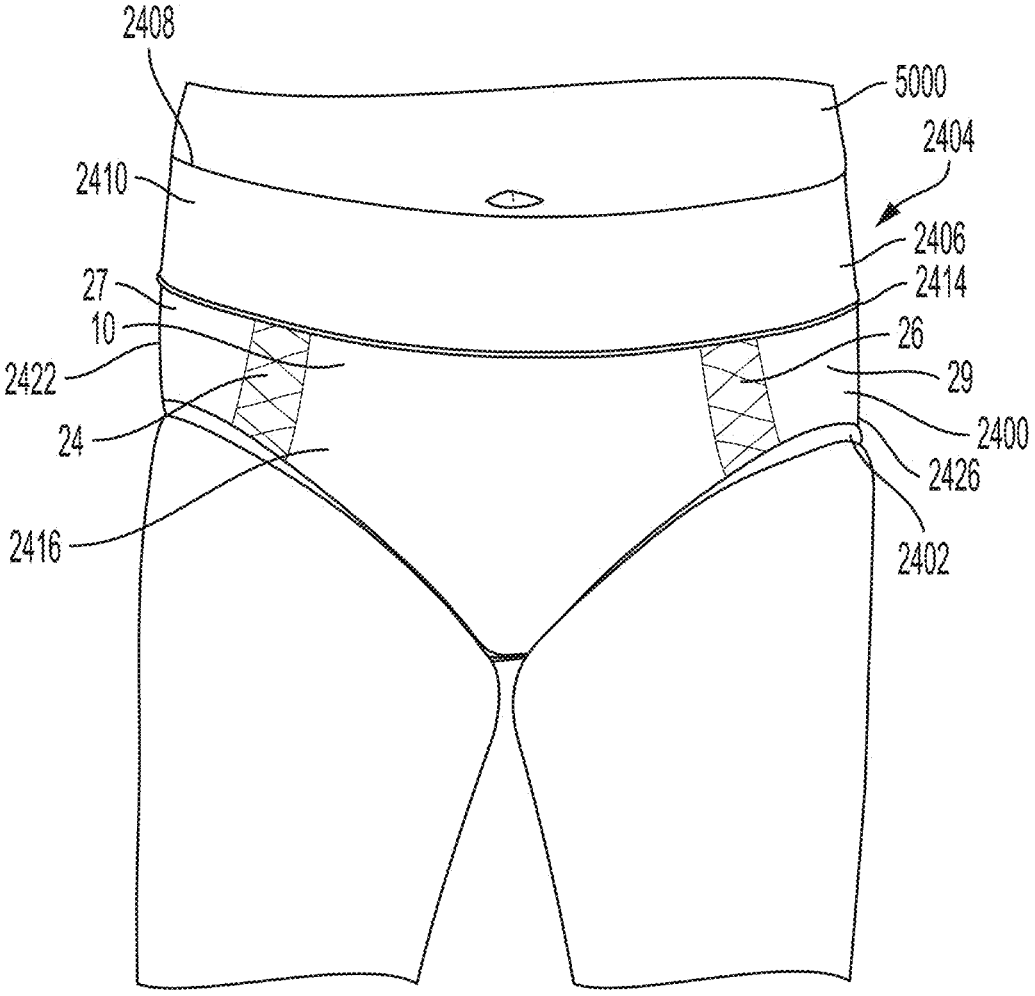
FIG. 24 is a front view of a fourth embodiment of the liner of FIG. 1 omitting the waist transition region, a waist whittler region, a super waist whittler region, and portions of a buttocks portion, an abdominal region, a first abdominal border region and a second abdominal border region, a top buttocks surrounding region, a side buttocks surrounding region, a first side hip region and a second side hip region, with the fourth embodiment of the liner shown in an assembled configuration connected to an outer shell forming a low waist brief, and the brief is inside-out on a wearer's body to show the interior thereof.
Figure 25:
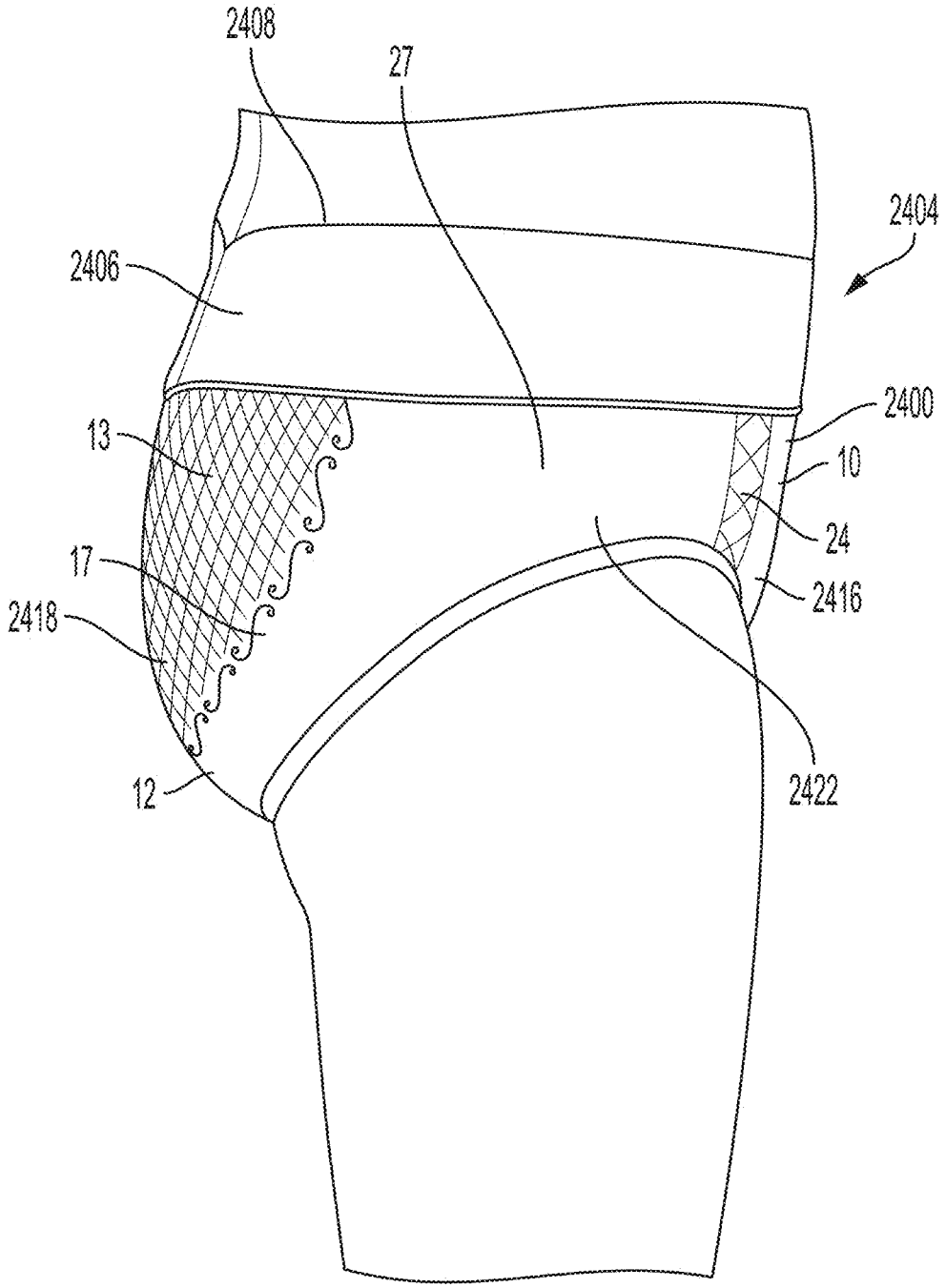
FIG. 25 is a side view of the brief of FIG. 24, the brief being inside-out on the wearer's body to show the interior thereof.

Referring to FIG. 24, a fourth embodiment of liner 100 is shown and is generally referred to liner 2400. Liner 2400 is shown in an assembled configuration connected to an outer shell 2402 forming a low waist brief 2404, and low waist brief 2404 is inside-out on a wearer's body to show the interior thereof. Low waist brief 2404 can be considered a bikini. Liner 2400 is the same as liner 100 except liner 2400 omits waist transition region 22, waist whittler region 18, super waist whittler region 8, and portions of buttocks region 13, abdominal region 10, first abdominal border region 24 and second abdominal border region 26, top buttocks surrounding region 15, side buttocks surrounding region 17, first side hip region 27 and second side hip region 29.

Figure 27:
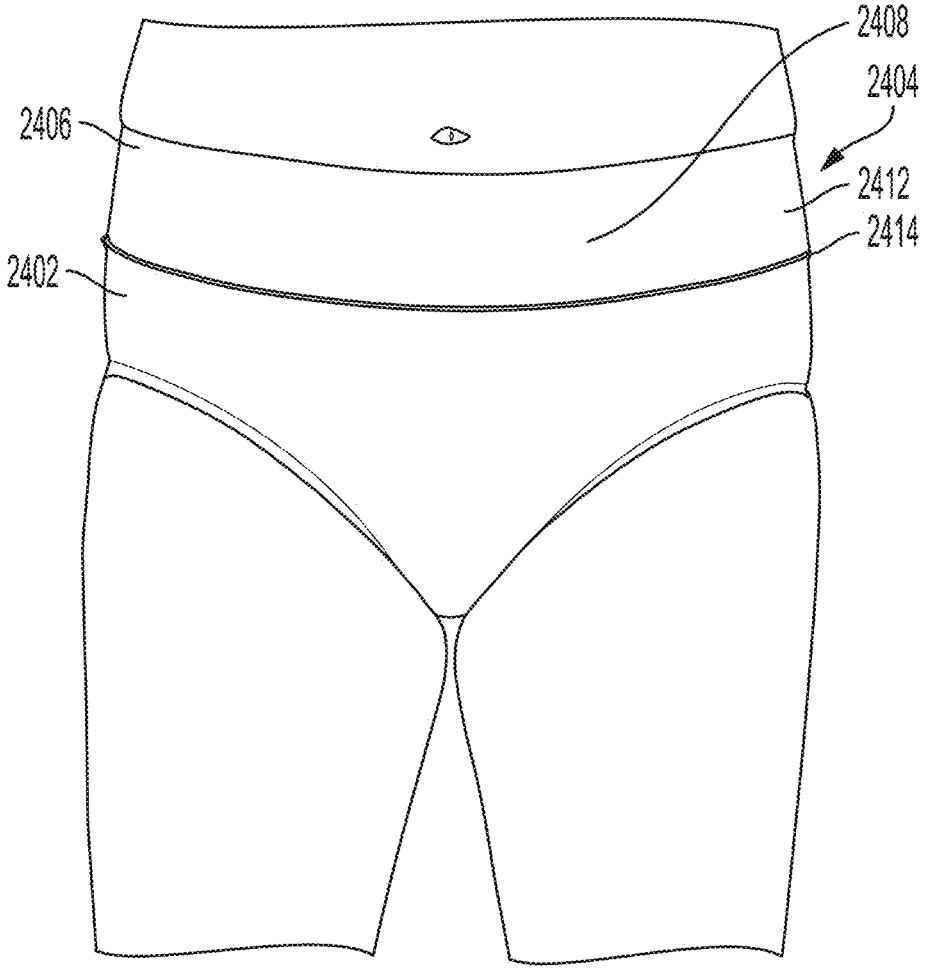
FIG. 27 is a front view of the brief of FIG. 24, the brief being on the wearer's body to show the exterior thereof.
Figure 28:
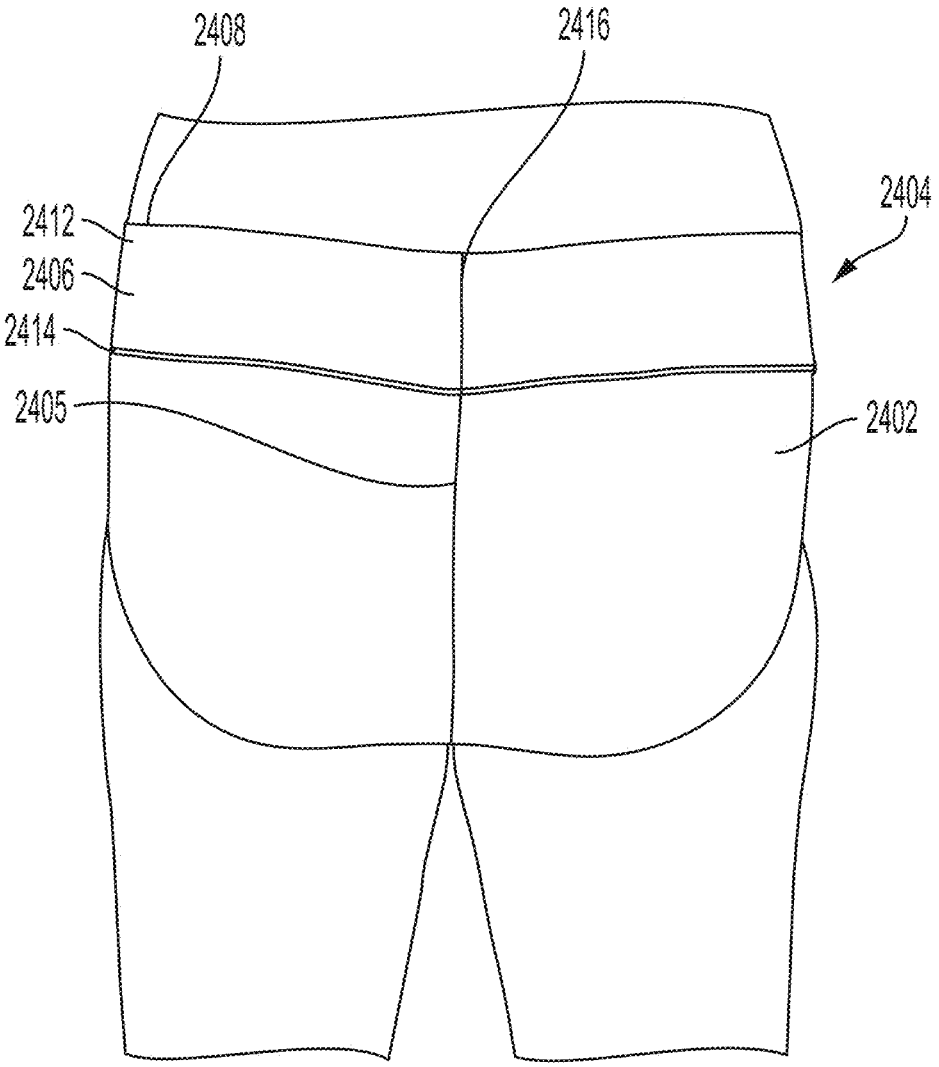
FIG. 28 is a rear view of the brief of FIG. 24, the brief being on the wearer's body to show the exterior thereof.

Outer shell 2402 is similar to outer shell 200 and outer shell 2402 is connected to liner 2400 in a similar way that outer shell 200 is connected to liner 100 forming center back seam 2405 (FIG. 28) that is similar to center back seam 2002. Outer shell 2402 is connected to a waistband 2406. Waistband 2406 is made of a single ply of fabric that is folded to form a fold 2408 and two plies of fabric 2410, 2412 (FIGS. 27-28) that are connected at seam 2414 and seam 2416 (FIG. 28). The material of waistband 2406 provides support of the abdomen of wearer's body 5000 to reshape wearer's body 5000.

Abdominal region 10, first abdominal border region 24 and second abdominal border region 26, buttocks region 13, bottom buttocks surrounding region 12, side buttocks surrounding region 17, top buttocks surrounding region 15, first side hip region 27 and second side hip region 29 of liner 2400 provide the same functionality as liner 100; however, the functionality is slightly lessened because they are partially present. Low waist brief 2404 can be worn with a swim top having liner 1200 of FIG. 12A. Liner 2400 together with liner 1200 provide substantially all of the functionality of liner 100. As shown in Table 10 below for liner 2400 that can be for a bikini, buttocks region 13 has the lowest modulus @ 30% in the length direction on the body and width direction around the body of those regions that were measured. In particular, side buttocks surrounding region 17 has a modulus @ 30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @ 30% in the width direction around the body that is equal to or greater than 62% more than buttocks region 13. Abdominal region 10 has a modulus @ 30% in the length direction on the body that is equal to or greater than 108% more than buttocks region 13 and the width direction around the body that is equal to or greater than 100% more than buttocks region 13. First abdominal border region 24 and second abdominal border region 26 have a modulus @ 30% in the length direction on the body that is equal to or greater than 39% more than buttocks region 13.

In addition, side buttocks surrounding region 17 has a modulus @30% in the length direction on the body that is greater than 65% more than abdominal region 10. First side hip region 27 and second side hip region 29 have a modulus @ 30% in the length direction on the body that is equal to or greater than 87% more than abdominal region 10 and a modulus @ 30% in the width direction around the body that is equal to or greater than 19% lower than abdominal region 10. Buttocks region 13 has a modulus @ 30% in the length direction on the body that is equal to or greater than 52% less than abdominal region 10 and the width direction around the body that is equal to or greater than 100% less than abdominal region 10. First abdominal border region 24 and second abdominal border region 26 have a modulus @ 30% in the length direction on the body that is equal to or greater than 33% less than abdominal region 10.

TABLE 10

FIG. 26-BIKINI BRIEF

| REGION | L ON BODY-modulus @ 30% | W ON BODY-modulus @ 30% | 45° ANGLE-modulus @ 30% | % lower than Buttocks region 13 for L ON BODY-modulus @ 30% | % lower than Buttocks region 13 for W ON BODY-modulus @ 30% | % lower (−) or % higher (+) than Abdominal region 10 for L ON BODY-modulus @ 30% | % lower (−) or % higher (+) than Abdominal region 10 for W ON BODY-modulus @ 30% |
|---|---|---|---|---|---|---|---|
| Buttocks region 13 | 0.41 | 0.53 | | | | −52% | −100% |

TABLE 10-continued

Figure 26:
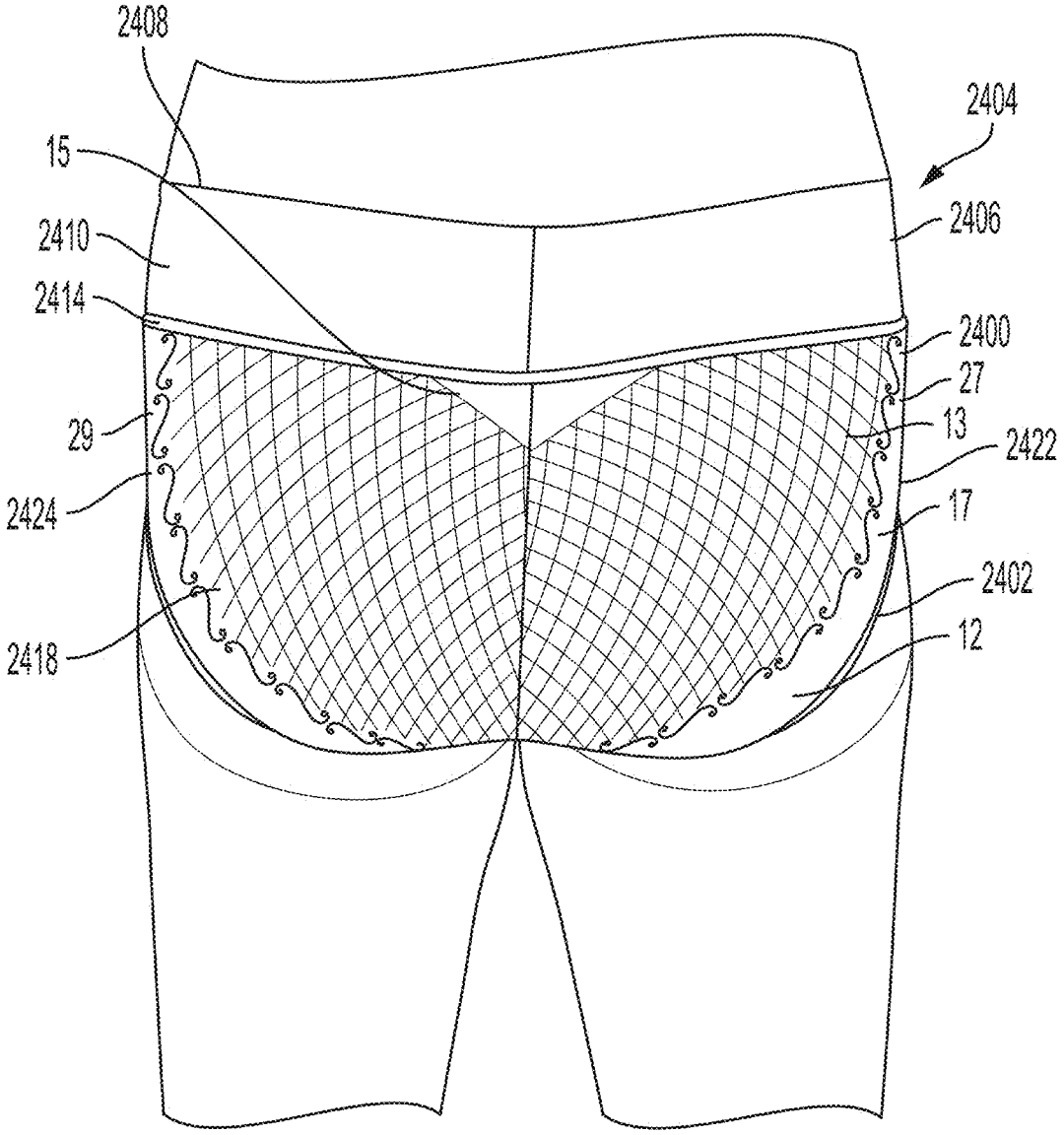
FIG. 26 is a rear view of the brief of FIG. 24, the brief being inside-out on the wearer's body to show the interior thereof.

| FIG. 26-BIKINI BRIEF | | | | | | | |
|---|---|---|---|---|---|---|---|
| REGION | L ON BODY-modulus @ 30% | W ON BODY-modulus @ 30% | 45° ANGLE-modulus @ 30% | % lower than Buttocks region 13 for L ON BODY-modulus @ 30% | % lower than Buttocks region 13 for W ON BODY-modulus @ 30% | % lower (−) or % higher (+) than Abdominal region 10 for L ON BODY-modulus @ 30% | % lower (−) or % higher (+) than Abdominal region 10 for W ON BODY-modulus @ 30% |
| Top Buttocks surrounding region 15 | | | 0.38 | | | | |
| Side Buttocks surrounding region 17 | 1.41 | | | 244% | | +65% | |
| Bottom Buttocks surrounding region 12 | | | 1.69 | | | | |
| First Side Hip region 27, Second Side Hip region 29 | 1.6 | 0.86 | | 290% | 62% | +87% | −19% |
| Abdominal region 10 | 0.855 | | | 108% | 100% | | |
| First abdominal border region 24, Second Abdominal border region 26 | 0.57 | | | 39% | | −33% | |

Alternatively, liner 2400 could form a front portion 2416, as shown in FIG. 24, that is separate from a rear portion 2418, as shown in FIG. 26. Front portion 2416 and rear portion 2418 can be connected to each other by two side seams each on sides 2422, 2424 as shown in FIG. 24.

Another alternative, modification or embodiment to liner has a low waist brief that is only front portion 2416 of liner 2400. In this modification of liner 2400, front portion 2416 is connected to outer shell 2402 by two side seams on opposite sides 2422, 2424. Rear portion 2418 of liner 2400 shown in FIG. 26 is not included in this modification of liner 2400, but a different rear portion of another lining fabric could or could not be optional.

In this modification of liner 2400, front portion 2416 provides the functionality of regions discussed for the above embodiment of liner 2400, that are present in this modification, namely, abdominal region 10, first abdominal border region 24 and second abdominal border region 26. Functionality as described for first side hip region 27 and second side hip region 29 of liner 2400 is present but lessened because less of first side hip region 27 and second side hip region 29 are present. As shown in Table 11 below for liner 2400 that can be for a bikini, abdominal region 10 has a modulus @ 30% in the width direction around the body that is equal to or greater than 33 percent higher than first abdominal border region 24 and second abdominal border region 26 and equal to or greater than 87 percent lower than first side hip region 27, second side hip region 29.

TABLE 11

| FIG. 24-BIKINI BRIEF FRONT-180° | | | | |
|---|---|---|---|---|
| REGION | L ON BODY-modulus @ 30% | W ON BODY-modulus @ 30% | 45° ANGLE-modulus @ 30% | % lower (−) or % higher (+) than Abdominal region 10 for L ON BODY-modulus @ 30% |
| Abdominal region 10 | 0.855 | | | |
| First abdominal border region 24, Second Abdominal border region 26 | 0.57 | | | −33% |
| First Side Hip region 27, Second Side Hip region 29 | 1.6 | | | +87% |

Still another alternative modification, or embodiment that the low waist brief is using only rear portion 2418 of liner 2400. In this modification of liner 2400, rear portion 2418 is connected to outer shell 2402 by two side seams on opposite sides 2422, 2424. Front portion 2416 of liner 2400 shown in FIG. 24 is not included in this modification of liner 2400, but a different front portion of another lining fabric could or could not be optional.

In this modification of liner 2400, rear portion 2418 provides the functionality of regions that are present, namely, the portion of side buttocks surrounding region 17, top buttocks surrounding region 15, bottom buttocks surrounding region 12, and buttocks region 13. Functionality as described for first side hip region 27 and second side hip region 29 of liner 2400 is present but lessened because less of first side hip region 27 and second side hip region 29 are present. As shown in Table 12 below for liner 2400 that can be for a bikini, buttocks region 13 has the lowest modulus @ 30% in the length direction on the body and width direction around the body of those regions that were measured. In particular, side buttocks surrounding region 17 has a modulus @ 30% in the length direction on the body that is equal to or greater than 244% more than buttocks region 13. First side hip region 27 and second side hip region 29 have a modulus @ 30% in the length direction on the body that is equal to or greater than 290% more than buttocks region 13 and a modulus @ 30% in the width direction around the body that is equal to or greater than 62% more than buttocks region 13.

TABLE 12

FIG. 26-BIKINI BRIEF REAR

| REGION | L ON BODY-modulus @ 30% | W ON BODY-modulus @ 30% | 45° ANGLE-modulus @ 30% | % lower than Buttocks region 13 for L ON BODY-modulus @ 30% | % lower than Buttocks region 13 for W ON BODY-modulus @ 30% |
|---|---|---|---|---|---|
| Buttocks region 13 | 0.41 | 0.53 | | | |
| Top Buttocks surrounding region 15 | | | 0.38 | | |
| Side Buttocks surrounding region 17 | 1.41 | | | 244% | |
| Bottom Buttocks surrounding region 12 | | | 1.69 | | |
| First Side Hip region 27, Second Side Hip region 29 | 1.6 | 0.86 | | 290% | 62% |

Figure 29:
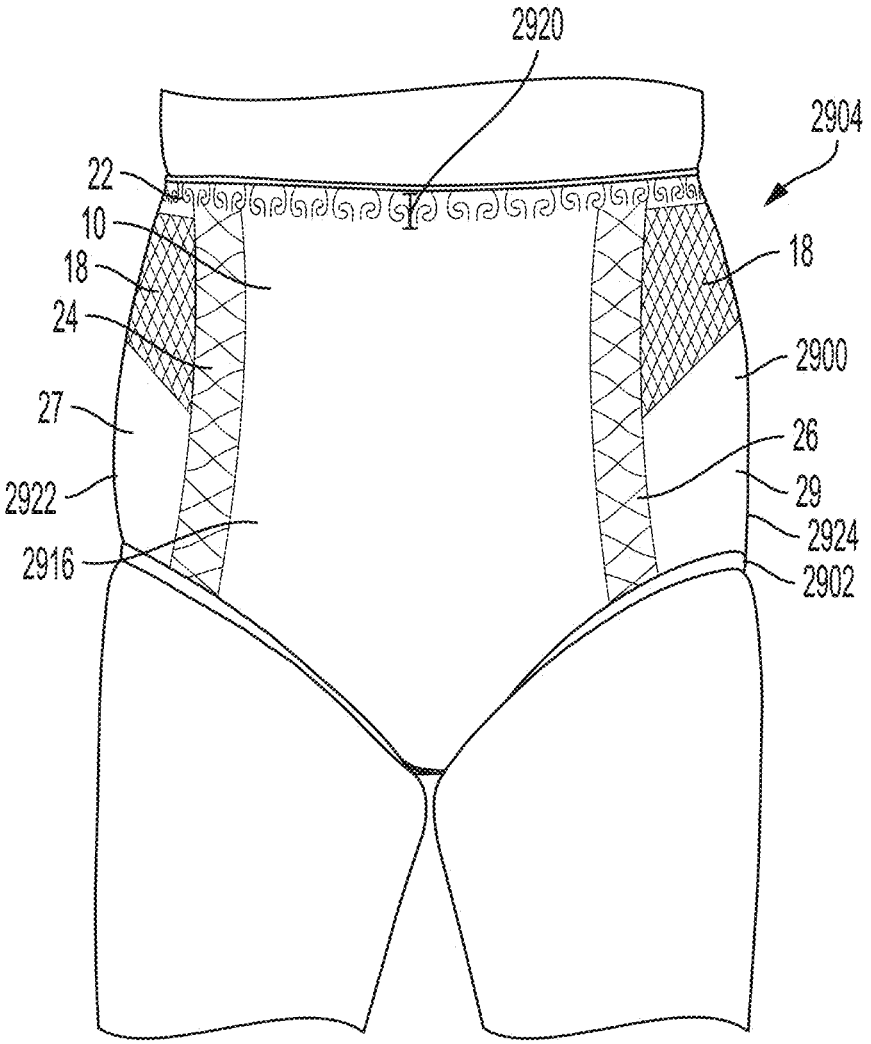
FIG. 29 is a front view of a fifth embodiment of the liner of FIG. 1 omitting a portion of the waist transition region, with the fifth embodiment of the liner shown in an assembled configuration connected to an outer shell forming an intermediate waist brief, and the brief is inside-out on a wearer's body to show the interior thereof.
Figure 30:
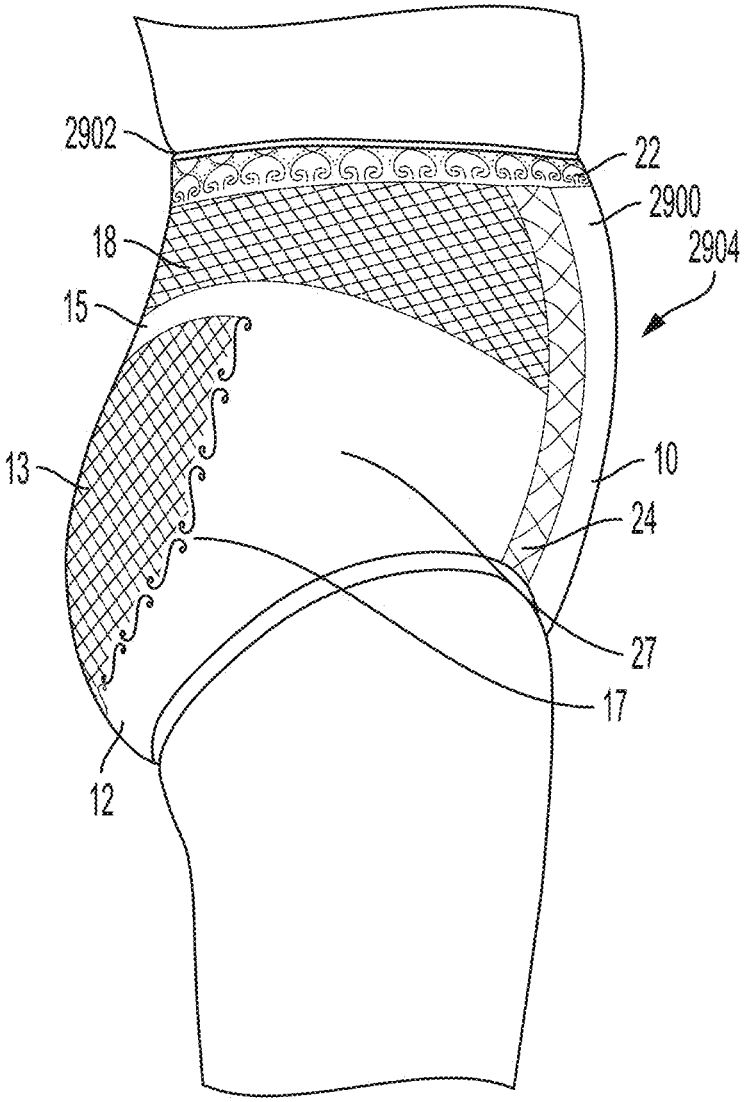
FIG. 30 is a side view of the brief of FIG. 29, the brief being inside-out on the wearer's body to show the interior thereof.

Referring to FIG. 29, a fifth embodiment of liner 100 is shown and is generally referred to liner 2900. Liner 2900 is shown in an assembled configuration connected to an outer shell 2902 forming an intermediate waist brief 2904, and intermediate waist brief 2904 is inside-out on a wearer's body to show the interior thereof. Liner 2900 is the same as liner 100 except liner 2900 omits a portion of waist transition region 22. Table 2 herein also includes data applicable to liner 2900.

Figure 33:
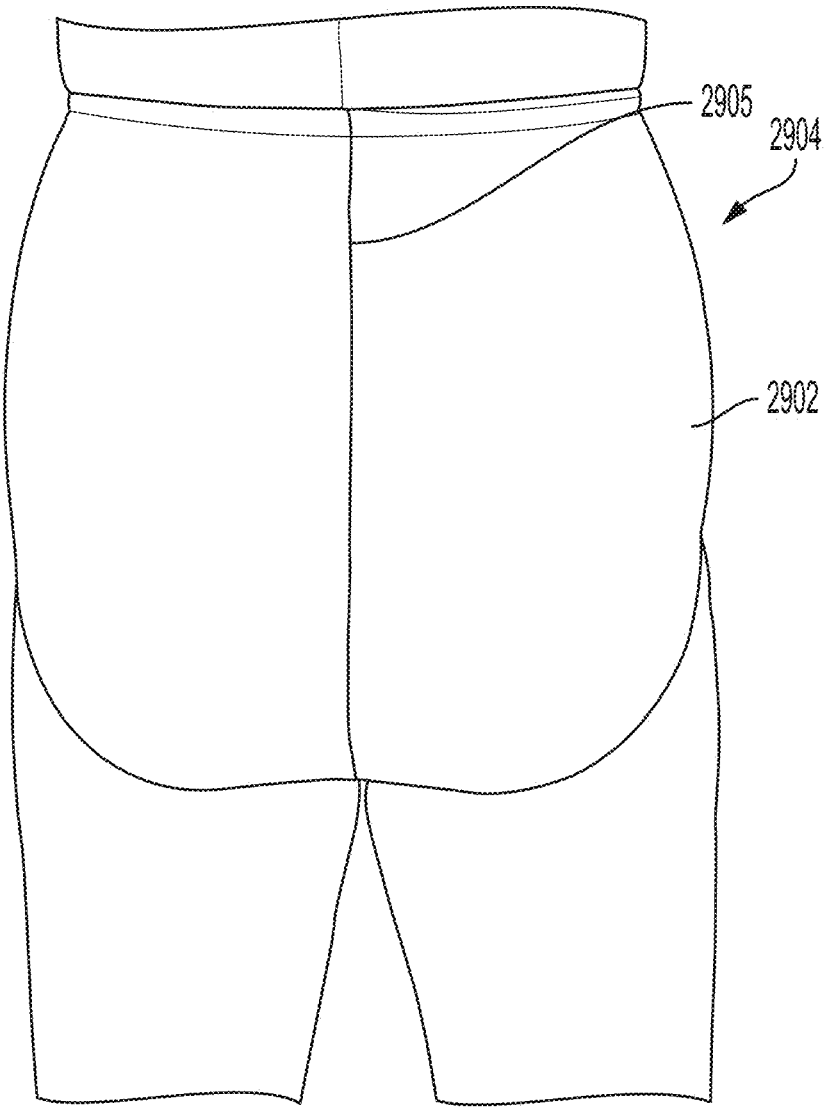
FIG. 33 is a rear view of the brief of FIG. 29, the brief being on the wearer's body to show the exterior thereof.

Outer shell 2902 is similar to outer shell 200 and outer shell 2902 is connected to liner 2900 in a similar way that outer shell 200 is connected to liner 100 forming center back seam 2905 (FIG. 33) that is similar to center back seam 2002. Liner 2900 connected to outer shell 2902 can also be connected to an elastic band that surrounds the top of liner at waist transition region 22. Liner 2900 connected to outer shell 2902 and the elastic band can also have a strip of material attached to top of liner 2900 with the elastic band to allow grading and fit function.

Abdominal region 10, first abdominal border region 24 and second abdominal border region 26, buttocks region 13, bottom buttocks surrounding region 12, side buttocks surrounding region 17, top buttocks surrounding region 15, first side hip region 27 and second side hip region 29, waist whittler region 18, waist transition region 22, super waist whittler region 8, and the crotch region of liner 2900 have the same functionality as liner 100. Waist transition region 22 of liner 2900 provides the same functionality as liner 100; however, the functionality is slightly lessened because waist transition region 22 is partially present.

Figure 31:
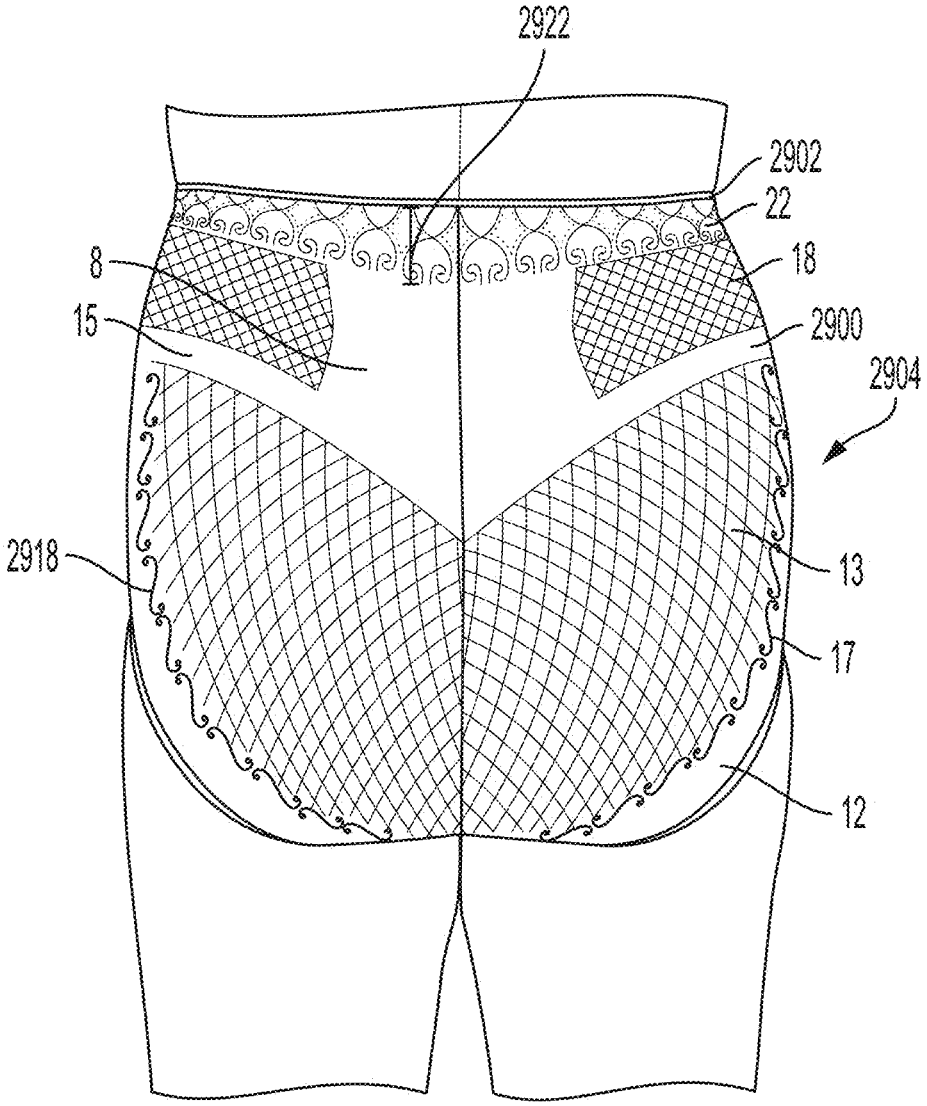
FIG. 31 is a rear view of the brief of FIG. 29, the brief being inside-out on the wearer's body to show the interior thereof.
Figure 32:
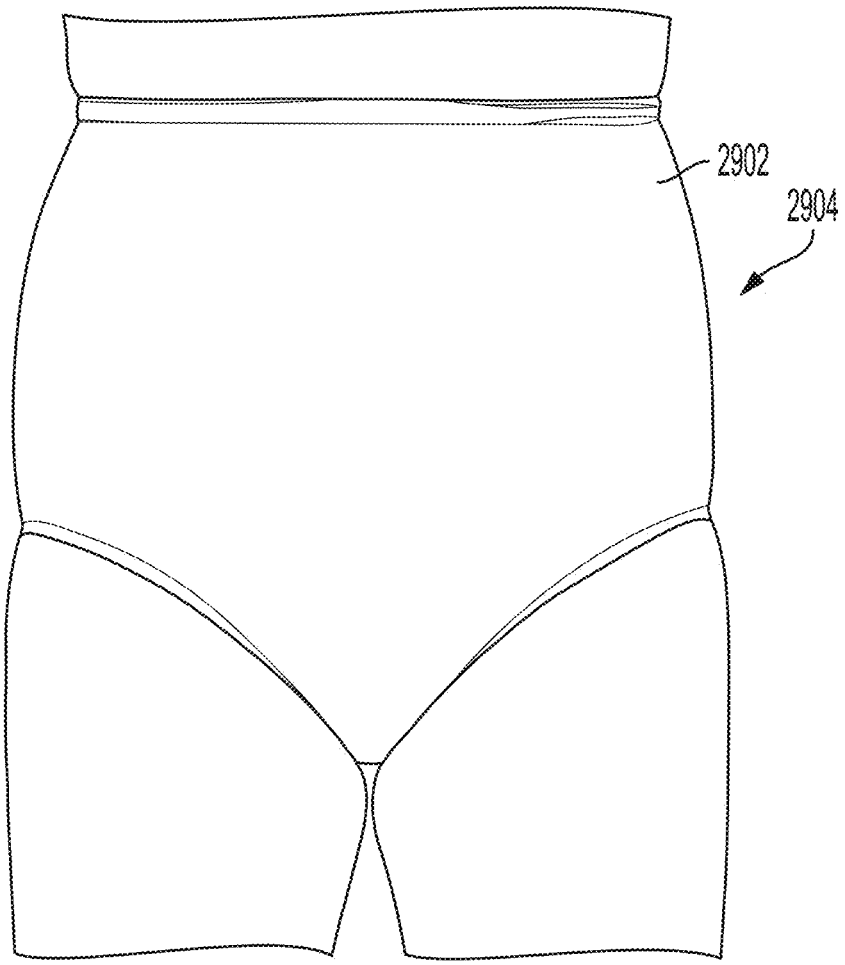
FIG. 32 is a front view of the brief of FIG. 29, the brief being on the wearer's body to show the exterior thereof.

Alternatively, liner 2900 could form a front portion 2916, as shown in FIG. 29, that is separate from a rear portion 2918, as shown in FIG. 31. Front portion 2916 and rear portion 2918 can be connected to each other by two side seams each on sides 2922, 2924 as shown in FIG. 29.

Another alternative, modification or embodiment to liner has an intermediate waist brief that is only front portion 2916 of liner 2900. In this modification of liner 2900, front portion 2916 is connected to outer shell 2902 by two side seams on opposite sides 2922, 2924. Rear portion 2918 of liner 2900 shown in FIG. 31 is not included in this modification of liner 2900, but a different rear portion of another lining fabric could or could not be optional. Table 3 herein also includes data applicable to liner 2900.

In this modification of liner 2900, front portion 2916 provides the functionality of regions discussed for the above embodiment of liner 2900, that are present in this modification, namely, abdominal region 10, first abdominal border region 24 and second abdominal border region 26. Functionality as described for waist whittler region 18, waist transition region 22, first side hip region 27 and second side hip region 29 of liner 2900 is present but lessened because less of waist whittler region 18, waist transition region 22, first side hip region 27 and second side hip region 29 are present.

Still another alternative modification, or embodiment that the intermediate waist brief 2904 is using only rear portion 2918 of liner 2900. In this modification of liner 2900, rear portion 2918 is connected to outer shell 2902 by two side seams on opposite sides 2922, 2924. Front portion 2916 of liner 2900 shown in FIG. 29 is not included in this modification of liner 2900, but a different front portion of another lining fabric could or could not be optional. Table 4 herein also includes data applicable to liner 2900.

In this modification of liner 2900, rear portion 2918 provides the functionality of regions that are present, namely, side buttocks surrounding region 17, top buttocks surrounding region 15, bottom buttocks surrounding region 12, buttocks region 13, and super waist whittler region 8. Functionality as described for first side hip region 27 and second side hip region 29, waist whittler region 18, and waist transition region 22 is present but lessened because less of first side hip region 27 and second side hip region 29, waist whittler region 18, and waist transition region 22 are present.

Waist transition region 22 can vary in width around intermediate waist brief 2904. Waist transition region 22 has a front width 2920, as shown in FIG. 29, in front portion 2916, and rear width 2922, as shown in FIG. 31, in rear portion 2918. Front width 2920 can be ¼ inch to 1½ inches, in one embodiment, for size 6. Front width 2920 can be ¼ inch to 1¾ inches, in one embodiment, for size 8. Front width 2920 can be ½ inch to 2 inches, in one embodiment, for size 10. Front width 2920 can be ¾ inch to 2⅜ inches, inches in one embodiment, for size 12. Front width 2920 can be ¼ inch to 1¾ inches, in one embodiment, for size 14. Front width 2920 can be ½ inch to 2 inches, in one embodiment, for size 16. Front width 2920 can be ¾ inch to 2⅜ inches, in one embodiment, for size 18. Rear width 2922 can be ½ inch to 2 inches, in one embodiment, for size 6. Rear width 2922 can be ¾ inch to 2¼ inches, in one embodiment, for size 8. Rear width 2922 can be ⅞ inch to 2¾ inches, in one embodiment, for size 10. Rear width 2922 can be 1 inch to 3 inches, in one embodiment, for size 12. Rear width 2922 can be ¾ inch to 2½ inches, in one embodiment, for size 14. Rear width 2922 can be ⅞ inch to 2¾ inches, in one embodiment, for size 16. Rear width 2922 can be 1 inch to 3 inches, in one embodiment, for size 18.

Liner 100, 600, 1200, 2400, 2900 allow one fabric design patterning for multiple sizes. However, there may be multiple fabric design patterning versions for different size ranges, of the same style garment.

It should also be noted that the terms "first", "second", "third", "upper", "lower", "side", "bottom", "top" and the like can be used herein to modify various elements. These modifiers do not imply a spatial, sequential, or hierarchical order to the modified elements unless specifically stated.

The numerical values provided herein can have a range that is 15% plus/minus the value provided.

While the present disclosure has been described with reference to one or more exemplary embodiments, it will be understood by those skilled in the art that various changes can be made and equivalents may be substituted for elements thereof without departing from the scope of the present disclosure. In addition, many modifications can be made to adapt a particular situation or material to the teachings of the present disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A liner comprising:

a fabric body that covers at least a hip area and an abdomen area of a wearer, the fabric body having a plurality of regions, the plurality of regions including at least a first region and a second region, the first region and the second region each having a different modulus than another of the plurality of regions, the first region being an abdominal region in which it can attain a modulus of between 0.742 to 1.272 at 30 percent elongation with a 15 pound load in a width direction on a wearer, and the second region being selected from the group consisting of a first abdominal border region, a second abdominal border region, a buttocks region, a bottom buttocks surrounding region, a top buttocks surrounding region, a side buttocks surrounding region, a side hip region, a waist whittler region, a waist transition region, a super waist whittler region, and any combination thereof.

2. The liner of claim 1, wherein the liner forms or is part of a garment selected from the group consisting of a panty, jeans, leggings, jeggings, legwear, hosiery, dress, pants, a skirt, a swimsuit bottom, a lingerie body suit and/or all body suits, a shapewear bottom, and any combination thereof.

3. The liner of claim 1, wherein the second region is the buttocks region.

4. The liner of claim 3, further comprising a third region that is the bottom buttocks surrounding region, the top buttocks surrounding region, and the side buttocks surrounding region.

5. The liner of claim 4, further comprising a fourth region that is the side hip region.

6. The liner of claim 5, further comprising a fifth region that is the waist whittler region.

7. The liner of claim 6, further comprising a sixth region that comprises the first abdominal border region and the second abdominal border region.

8. The liner of claim 7, further comprising a seventh region that is the waist transition region.

9. The liner of claim 8, wherein the abdominal region is between the first abdominal border region and the second abdominal border region, wherein the bottom buttocks surrounding region, the top buttocks surrounding region, and the side buttocks surrounding region surrounds the buttocks region, wherein the side hip region has a first side hip region on a side of the first abdominal border region opposite the abdominal region and a second side hip region on a side of the second abdominal border region opposite the abdominal region, wherein the waist whittler region has a first waist whittler region above the first side hip region and above the buttocks region and a second waist whittler region above the second side hip region and above the buttocks region, and wherein the waist transition region is above the waist whittler region, the super waist whittler region, the first abdominal border region, the second abdominal border region and the abdominal region.

10. The liner of claim 9, wherein the buttocks region can attain a modulus of between 0.371 to 0.689 at 30 percent elongation with a 15 pound load in the width direction on the body.

11. The liner of claim 9, wherein the side hip region can attain a modulus of between 0.602 to 1.118 at 30 percent elongation with a 15 pound load in the width direction on the body.

12. The liner of claim 9, wherein the side buttocks surrounding region can attain a modulus of between 0.987 to 1.833 at 30 percent elongation with a 15 pound load in the length direction on the body.

13. The liner of claim 9, wherein the waist whittler region can attain a modulus of between 0.399 to 0.741 at 30 percent elongation with a 15 pound load in the width direction on the body.

14. The liner of claim 9, wherein the first abdominal border region and the second abdominal border region each can attain a modulus of between 0.399 to 0.741 at 30 percent elongation with a 15 pound load in a length direction on the body.

15. The liner of claim 9, wherein the waist transition region can attain a modulus of between 0.504 to 0.936 at 30 percent elongation with a 15 pound load in the width direction on the body.

16. The liner of claim 1, wherein the second region is the side hips region and further comprising the waist whittler region, the first abdominal border region and the second abdominal border region, wherein the first abdominal border region and the second abdominal border region border opposite sides of the first region, wherein the side hips region has a first side hip region on a side of the first abdominal border region opposite the first region and a second side hip region on a side of the second abdominal border region opposite the first region, and wherein the waist whittler region has a first waist region above the first side hip region and a second waist region above the second side hip region.

17. The liner of claim 1, wherein the body of fabric is free of side seams.

18. The liner of claim 1, wherein the body of fabric has side seams.

19. The liner of claim 1, wherein the abdominal region covers an abdominal region and a crotch portion on the body.

20. The liner of claim 1, wherein the liner is connected to a garment shell.

21. The garment of claim 1, wherein the liner is only in a front portion of a garment.

22. A liner comprising:

a fabric body that covers at least a hip area and a buttocks area, the fabric body has a plurality of regions, the plurality of regions having at least a first region and a second region, the first region and the second region each having a different modulus than another of the plurality of regions, the first region being an buttocks region can attain a modulus of between 0.371 to 0.689 at 30 percent elongation with a 15 pound load in a width direction on the body, and the second region being selected from the group consisting of a first abdominal border region, a second abdominal border region, an abdominal region, a bottom buttocks surrounding region, a top buttocks surrounding region, a side buttocks surrounding region, a side hip region, a waist whittler region, a waist transition region, a super waist whittler region, and any combination thereof.

23. The garment of claim 22, wherein the liner is only in a rear portion of a garment.

24. The liner of claim 22, wherein the liner forms or is part of a garment selected from the group consisting of a panty, jeans, leggings, jeggings, legwear, hosiery, dress, pants, a skirt, a swimsuit bottom, a lingerie body suit and/or all body suits, a shapewear bottom, or any combination thereof.

* * * * *